US010139173B2

(12) United States Patent
Teach, Jr. et al.

(10) Patent No.: US 10,139,173 B2
(45) Date of Patent: Nov. 27, 2018

(54) LESS-LETHAL BALLISTIC PROJECTILE LAUNCHER

(71) Applicants: Thomas A. Teach, Jr., South Bend, IN (US); David C. Sult, South Bend, IN (US)

(72) Inventors: Thomas A. Teach, Jr., South Bend, IN (US); David C. Sult, South Bend, IN (US)

( * ) Notice: Subject to any disclaimer, the term of this patent is extended or adjusted under 35 U.S.C. 154(b) by 0 days.

(21) Appl. No.: 15/896,052

(22) Filed: Feb. 13, 2018

(65) Prior Publication Data

US 2018/0224229 A1 Aug. 9, 2018

Related U.S. Application Data

(62) Division of application No. 14/302,518, filed on Jun. 12, 2014, now Pat. No. 9,927,191, and a division of (Continued)

(51) Int. Cl.
*F41C 7/11* (2006.01)
*F41A 3/58* (2006.01)
(Continued)

(52) U.S. Cl.
CPC ..... *F41A 3/58* (2013.01); *F41A 3/60* (2013.01); *F41A 3/66* (2013.01); *F41A 9/01* (2013.01); *F41A 9/58* (2013.01); *F41A 15/06* (2013.01); *F41A 17/42* (2013.01); *F41A 17/68* (2013.01); *F41A 19/13* (2013.01); *F41A 19/14* (2013.01); *F41A 19/183* (2013.01); *F41A 19/21* (2013.01); *F41A 19/22* (2013.01); *F41A 21/02* (2013.01); *F42B 5/26* (2013.01)

(58) Field of Classification Search
CPC .... F41A 3/00; F41A 3/58; F41A 15/00; F41A 15/06; F41C 7/11; F42B 8/00; F42B 8/02
USPC .... 42/8, 40, 41, 42.02, 42.03, 46, 47, 70.01, 42/75.04; 102/444
See application file for complete search history.

(56) References Cited

U.S. PATENT DOCUMENTS 51,440 A * 12/1865 Elliot ..... F41A 19/10 42/69.01
1,578,638 A * 3/1926 Browning ..... F41A 3/58 42/42.01

(Continued)

*Primary Examiner* — Jonathan C Weber
(74) *Attorney, Agent, or Firm* — R. Tracy Crump

(57) ABSTRACT

The light-weight handheld less-lethal ballistic projectile launcher is configured as an "over/under" double barrel handheld device with a "break open" loading action. The launcher includes a barrel section pivotally connected to receiver section. The barrel section pivots between an open load/unload position and a closed firing position. The barrel section includes two metal barrel sleeves that are press fit into axial bores formed in the body of the barrel section. The barrel section also includes an ejector, which locks the barrel section in the closed firing position and partially expels spent rounds from the barrel sleeves when the barrel section is opened. The receiver section houses the launcher's fire control mechanism. The fire control mechanism uses a traditional single action operation and ensures that rounds are alternatively discharged from each barrel and prevents rounds from both barrels from being discharged simultaneously.

1 Claim, 23 Drawing Sheets

Related U.S. Application Data application No. 12/924,510, filed on Sep. 29, 2010, now Pat. No. 8,782,938.

(60) Provisional application No. 61/247,286, filed on Sep. 30, 2009.

(51) Int. Cl.

| | |
|---|---|
| ***F41A 21/02*** | (2006.01) |
| ***F41A 3/60*** | (2006.01) |
| ***F41A 9/01*** | (2006.01) |
| ***F41A 9/58*** | (2006.01) |
| ***F41A 17/42*** | (2006.01) |
| ***F41A 17/68*** | (2006.01) |
| ***F41A 19/18*** | (2006.01) |
| ***F41A 19/21*** | (2006.01) |
| ***F41A 19/22*** | (2006.01) |
| ***F42B 5/26*** | (2006.01) |
| ***F41A 3/66*** | (2006.01) |
| ***F41A 15/06*** | (2006.01) |
| ***F41A 19/13*** | (2006.01) |
| ***F41A 19/14*** | (2006.01) |

(56) References Cited

U.S. PATENT DOCUMENTS 1,674,907 A * 6/1928 Lindsay ..... F41A 15/06 42/40
1,924,656 A * 8/1933 Ribe ..... F41A 19/54 42/40
2,376,358 A * 5/1945 Horsrud ..... F41A 3/58 42/43
3,209,480 A * 10/1965 Mittelsteadt ..... F41A 17/74 42/41
3,217,441 A * 11/1965 Kerr ..... F41C 7/12 102/444
3,237,335 A * 3/1966 Kerr ..... F41A 19/41 102/444
3,249,048 A * 5/1966 Kerr ..... F41C 7/12 102/447
3,389,488 A * 6/1968 Beretta ..... F41A 19/19 42/42.01
3,984,933 A * 10/1976 Ruger ..... F41A 15/06 42/47
4,000,575 A * 1/1977 Ruger ..... F41A 3/58 42/44
4,489,515 A * 12/1984 Numbers ..... F41C 3/00 42/40
4,541,192 A * 9/1985 Flodman ..... F41C 7/11 42/40
5,109,621 A * 5/1992 Blaser ..... F41A 15/06 42/46
5,459,956 A * 10/1995 Rowlands ..... F41A 3/58 42/43
5,467,549 A * 11/1995 Rowlands ..... F41A 15/06 42/42.03
5,469,649 A * 11/1995 Rowlands ..... F41A 3/58 42/41
6,839,997 B2 * 1/2005 Popikow ..... F41A 15/06 42/47
6,907,687 B2 * 6/2005 Rousseau ..... F41A 3/58 42/75.02
8,782,938 B2 * 7/2014 Teach, Jr. ..... F41A 3/58 42/41

* cited by examiner

LESS-LETHAL BALLISTIC PROJECTILE LAUNCHER

This is a divisional application of U.S. patent application Ser. No. 14/302,518 filed Jun. 12, 2014, which is a divisional application of U.S. patent application Ser. No. 12/924,510 filed Sep. 29, 2010, which is now U.S. Pat. No. 8,782,938 issued Jul. 22, 2014, and which claims priority on U.S. Provisional Patent Application Ser. No. 61/247,286 filed on Sep. 30, 2009.

This invention relates to less-lethal weapons and in particular handheld less-lethal ballistic projectile launchers.

BACKGROUND OF THE INVENTION

Less-lethal projectile weapons provide law enforcement and military personnel with an alternative to firearms in hostile encounters. While firearms are necessary and appropriate for adjudicating deadly force encounters, less-lethal projectile weapons afford law enforcement and military personnel a tool, which can be effectively used across a broader range of the use of force spectrum. A suspect can be incapacitated by the blunt force impact of a projectile shot from a less-lethal weapon with less risk of serious injury to the suspect without exposing the officer or soldier to undue danger.

Less-lethal projectile weapons shoot a variety of projectiles, including bean bags, rubber slugs, rubber shot, and wood dowels. Compared to the lethal loads and bullets fired from conventional firearms, these blunt force impact projectiles are much larger, softer and travel at much slower velocities from the less-lethal projectile weapons so that they do not produce lethal penetrating wounds. Less-lethal projectiles weapons typically fall into two categories: specialized launchers that use compressed air to propel the projectiles and conventional firearms converted to use specialized ballistic projectile ammunition.

The compressed air launchers require a compressed air source, usually a canister, as well as specialized projectile rounds. Compressed air launchers are generally bulky and inconvenient to carry and deploy without additional specialized slings, holsters and pouches, which further occupy the limited space on the officer's duty belt or a soldier's equipment rig. The use of compressed air launchers also require specialized training and additional tactics to effectively deploy.

Conventional firearms that are converted to shoot specialized ballistic projectile ammunition present other drawbacks and potential problems. Special ballistic projectile rounds have been developed for use in conventional 12 gauge shotguns, such as the Remington 870 and Mossberg 500. These less-lethal projectile rounds, use a standard 2½" 12 gauge shell with a small charge that propels a bean bag, wood dowel, rubber slug or rubber shot. While other firearms have been converted to use other calibers of rounds, the 12 gauge shotgun shell generally provides the most suitable round for less-lethal projectile ballistic and is very cost effective. While convenient, there is a potential for confusion between less-lethal projectile rounds and conventional lethal ammunition rounds in a stressful tactical situation. Another drawback to converted shotguns is their size and weight. Shotguns are large weapons that generally require both hands to manipulate. Shotguns must be held or slung, rather than simply holstered.

SUMMARY OF THE INVENTION

The present invention provides light-weight handheld less-lethal ballistic projectile launcher. One embodiment of this invention is configured as an "over/under" double barrel handheld device with a "break open" loading action. This launcher includes a barrel section pivotally connected to a receiver section. The barrel section pivots between an open load/unload position and a closed firing position. The barrel section includes two metal barrel sleeves that are press fit into axial bores formed in the body of the barrel section. The barrel section also includes an ejector, which locks the barrel section in the closed firing position and partially expels spent rounds from the barrel sleeves when the barrel section is opened. The receiver section houses the launcher's fire control mechanism. The fire control mechanism uses a traditional single action operation and ensures that rounds are alternatively discharged from each barrel and prevents rounds from both barrels from being discharged simultaneously. Only less-lethal ballistic projectile rounds specifically designed for use with this one embodiment of launcher can be loaded or used, while other embodiments may accept standard less-lethal ballistic projectile rounds, but not conventional ammunition.

Accordingly, the present invention provides several advantages over compressed air launchers and conventional firearms that are converted for less-lethal ballistic projectile rounds. The handgun configuration allows the launcher to be manipulated, held and fired with one hand, as well as being conveniently carried and holstered. The over/under double barrel configuration provides a two shot capacity. The bodies of the receiver and barrel sections are constructed of reinforced polymer materials for durability and low weight. The break-open load action and ejector allows the launcher to be easily loaded and unloaded. The ejector provides a dual function in that it locks the barrel section in the firing position and pulls the spent rounds from the barrel section to ease reloading. The fire control mechanism provides simplicity of operation and reliability. The design and configuration of the barrel and receiver sections ensures that the launcher only operates using mating less-lethal projectile rounds and cannot be loaded or used with deadly conventional ammunition. In other embodiment of the launcher, the back plate can be modified to accommodate standard less-lethal projectile rounds as desired.

These and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
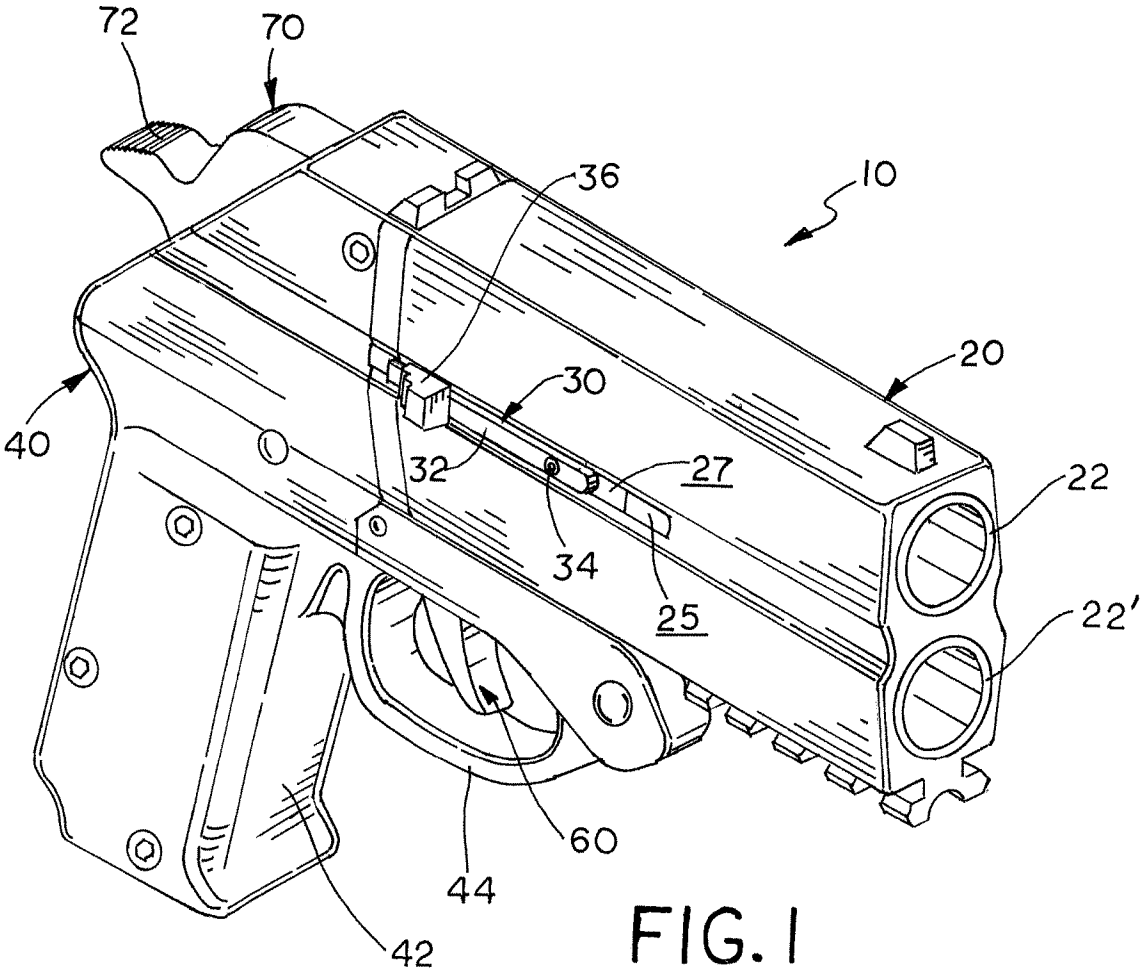
FIG. 1 is a perspective view of an embodiment of the less-lethal ballistic projectile launcher of this invention.
Figure 2:
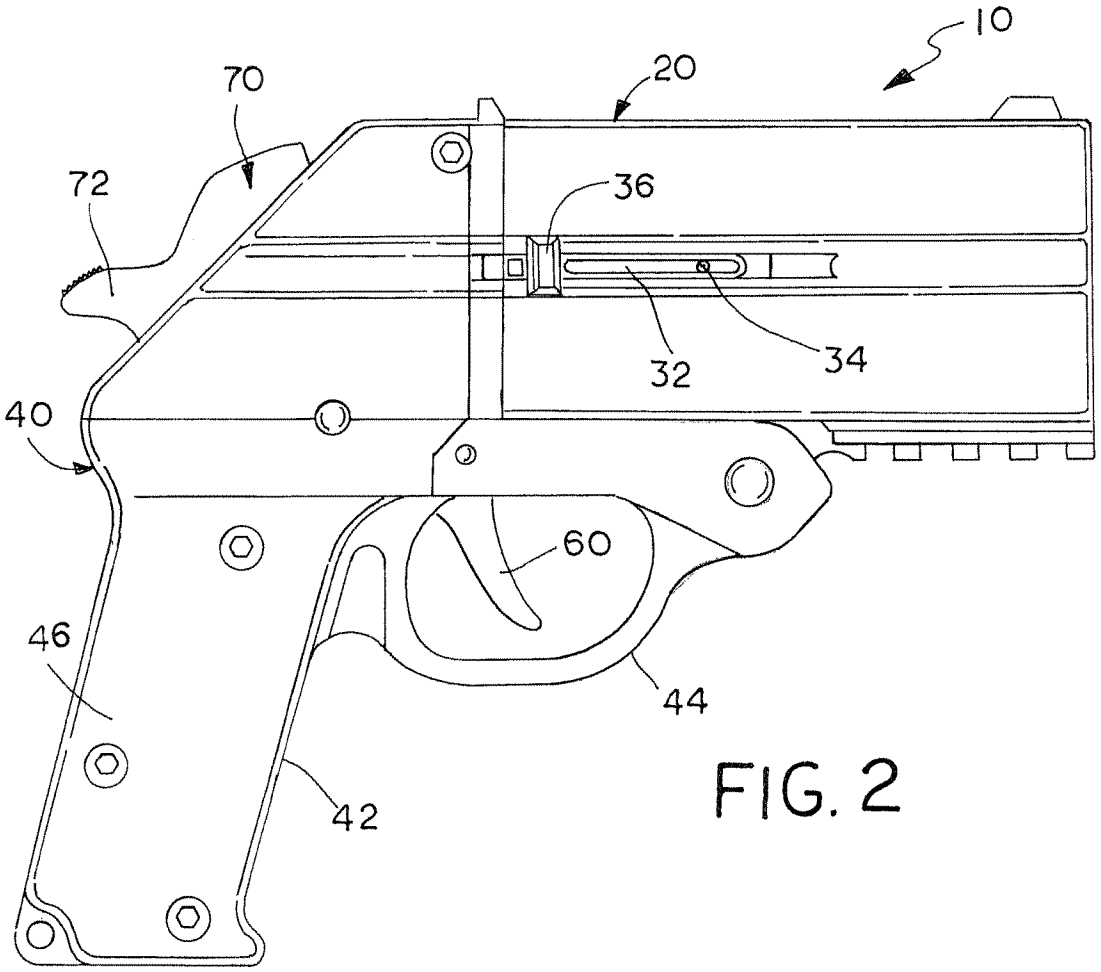
FIG. 2 is a right side view of the launcher of FIG. 1.
Figure 3:
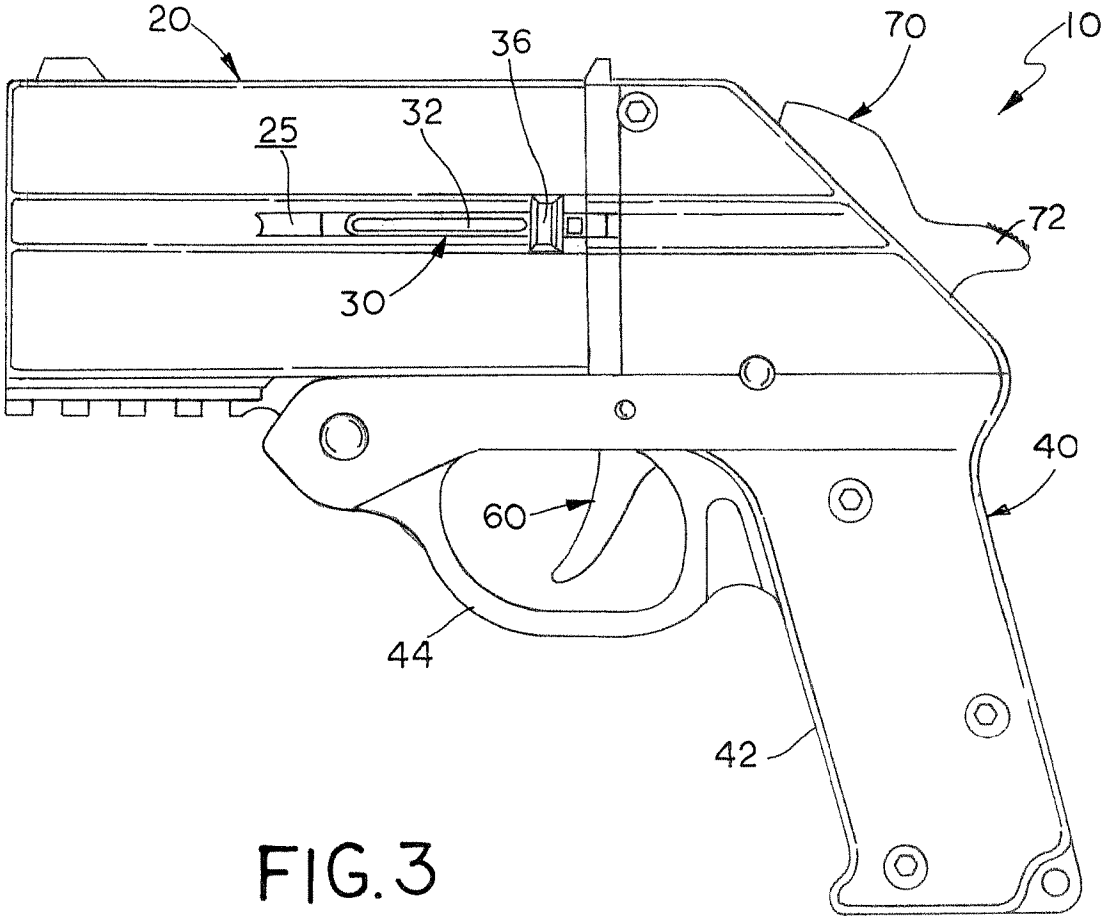
FIG. 3 is a right side view of the launcher of FIG. 1.
Figure 4:
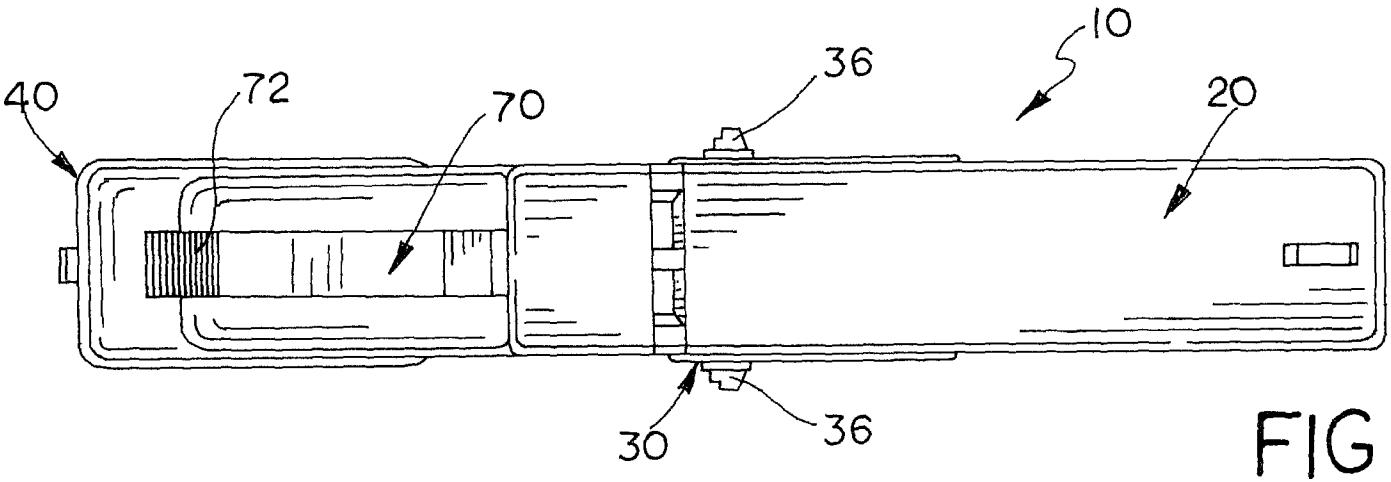
FIG. 4 is a top view of the launcher of FIG. 1.
Figure 5:
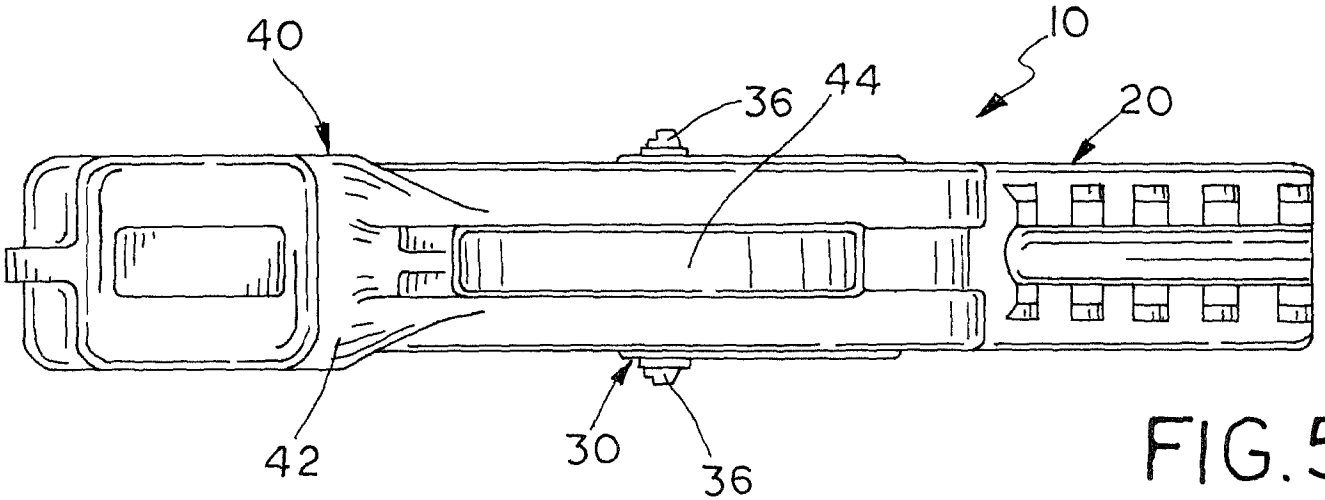
FIG. 5 is a bottom view of the launcher of FIG. 1.
Figure 7:
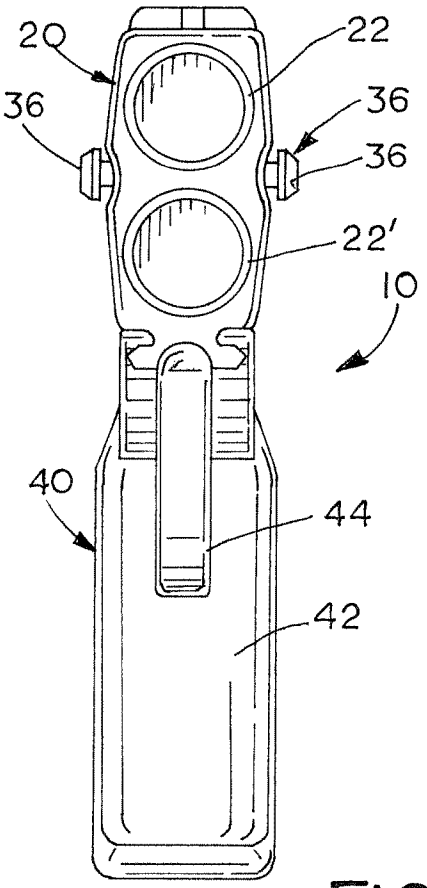
FIG. 7 is a back view of the launcher of FIG. 1.
Figure 6:
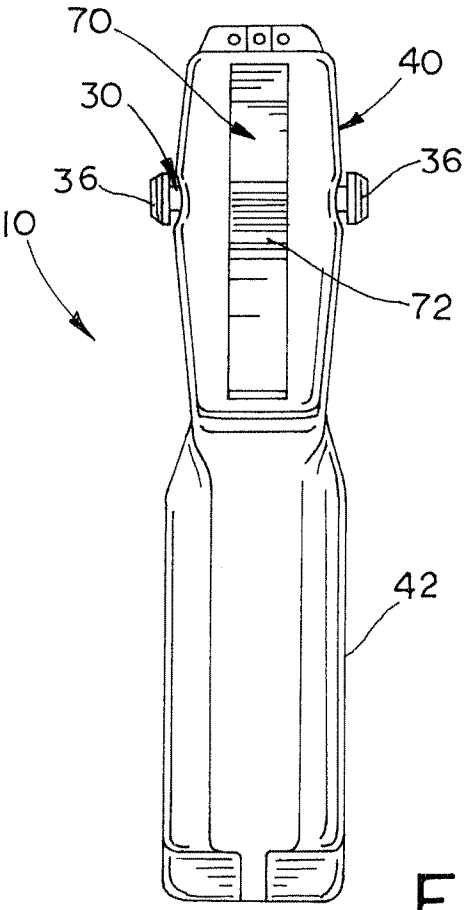
FIG. 6 is a front view of the launcher of FIG. 1.

Referring now to the drawings, FIGS. 1-27 show one embodiment of the less-lethal launcher of this invention, which is designated generally as reference numeral 10. In this embodiment, launcher 10 is configured as a handheld "over/under" double barrel less-lethal weapon. The double barrel configuration provides launcher 10 with a two shot capacity before reloading is required. Although, launcher 10 is illustrated with an "over/under" double barrel configuration, single barrel and other multiple barrel embodiments, such as "side-by-side double barrel" configurations are contemplated within the teachings of this invention. Launcher 10 also uses a "break open" loading action where the barrel section pivots away from the receiver so that rounds can be loaded directly into the barrels. Again, although a break open loading action is illustrated and described other embodiments may employ other loading actions and mechanisms.

Figure 11:
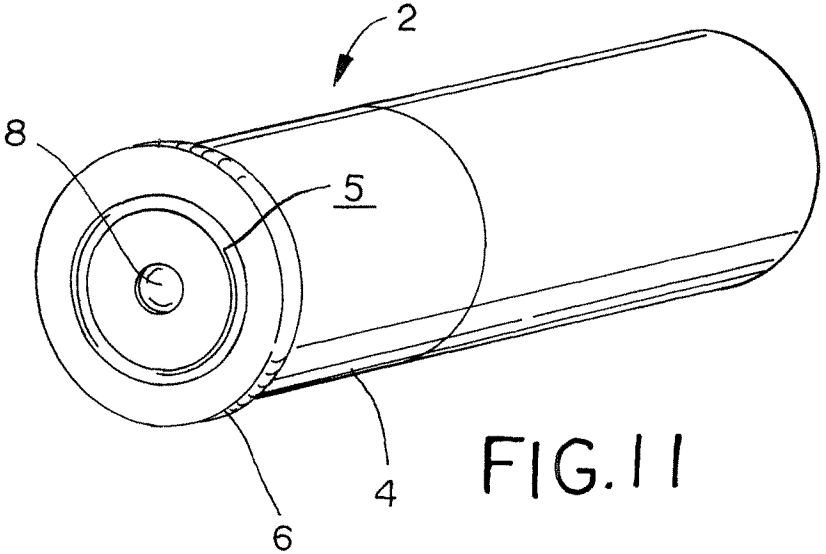
FIG. 11 is a perspective view of the mating less-lethal ballistic projectile round used in the launcher of FIG. 1.

Although other embodiments of this invention may be configured for use with conventional less-lethal ballistic projectile rounds, launcher 10 is specifically designed to be used only with specialized mating less-lethal projectile rounds and is inoperable with other less-lethal rounds and conventional lethal ammunition. These mating less-lethal projectile rounds can be loaded with a variety of blunt force projectiles, such as but not limited to, bean bags, rubber slugs, rubber shot, and wood dowels. FIG. 11 shows an embodiment of the mating less-lethal projectile rounds 2 of launcher 10. Round 2 has an annular recess 5 formed around the primer 6 on the back of the shell casing 4.

Figure 13:
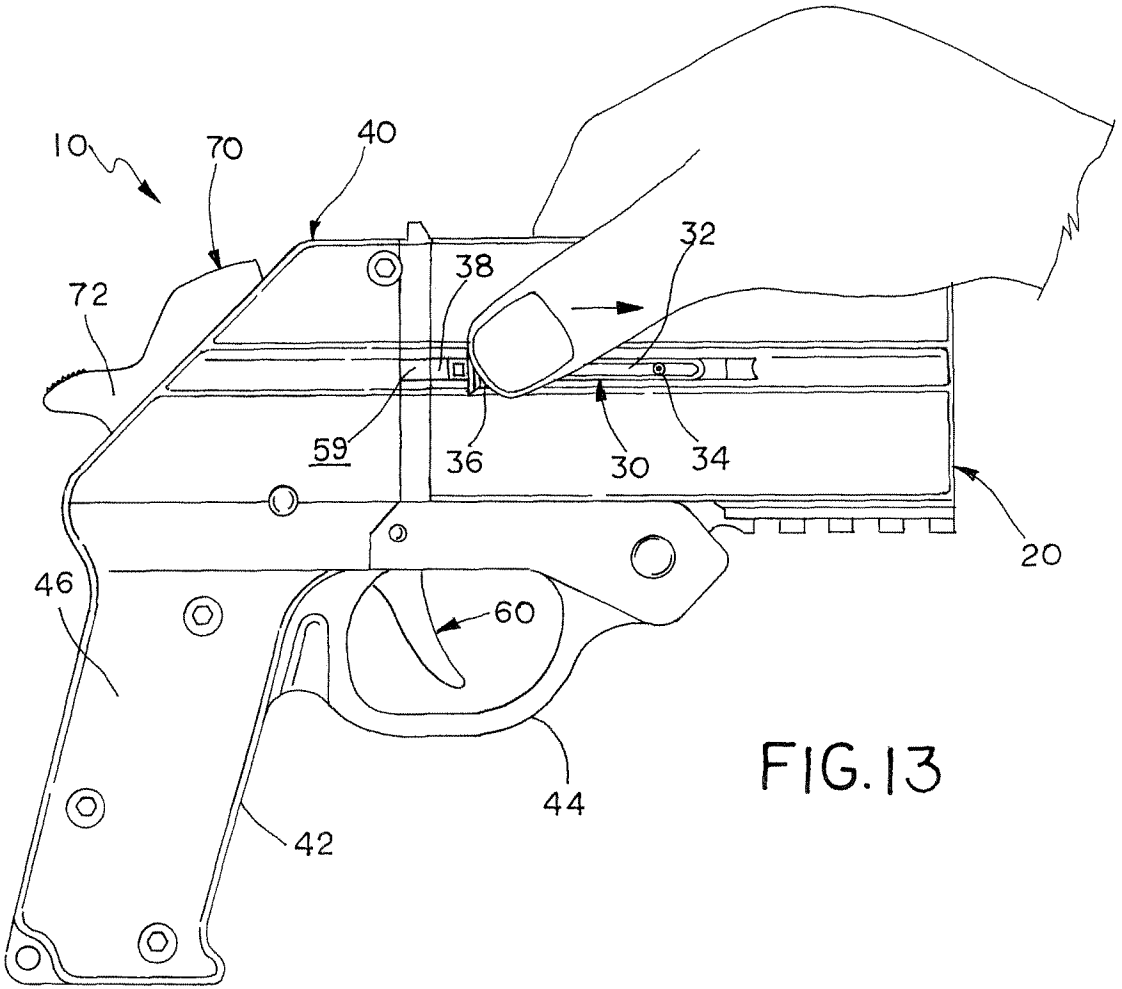
FIG. 13 is a side view of the launcher of FIG. 1 showing the ejector being pulled forward.

As shown, launcher 10 generally includes a barrel section 20 located at the fore or distal end of the launcher and a receiver section 40 located at the aft or proximal end of the launcher. Receiver section 40 is configured in the shape of a conventional handgun frame and includes a handle grip 42 and trigger guard 44. Barrel section 20 is pivotally connected to receiver section 40 by roll pin 48. Barrel section 20 pivots between an open "load/unload" position where the rear end of the barrel section is pivoted away from receiver section 40 (FIG. 15) and a closed "fire" position where the rear of the barrel section abuts receiver section (FIG. 13). Barrel section 20 has a forward end from where projectiles exit launcher 10 and a rear end where less-lethal ballistic projectile rounds are loaded into the barrel section. Both barrel section 20 and receiver section 40 are formed, molded or otherwise constructed from a durable, light weight polymer plastic or other composite material. Other suitable materials may be used including fiberglass reinforced nylon, but the materials used in the bodies of barrel section 20 and receiver section 40 are generally selected to be impact, heat and solvent resistant in addition to being durable and light weight.

Barrel section 20 includes two barrel sleeves 22 and 22' press fit into axial bores formed in the body of barrel section 20 in an "over-under" configuration. Each barrel sleeve 22 and 22' is a length of tubular steel, aluminum or other suitable metal. Each barrel sleeve 22 and 22' has a axial bore that runs their entire length. Each barrel sleeve 22 and 22' has a first diameter A and a second diameter B. The first diameter A is nearest the rear end of the barrel sleeves and is larger than the second diameter B. There is a tapered shoulder or chock 24 that transitions between diameters A and B. Taper shoulder 24 is spaced 2½ inches from the rear end of each barrel sleeve. It should be noted that 2¾ inch shells, which are the standard length for conventional 12 gauge ammunition with lethal loads, will protrude from rear end of barrel sleeves and prevent barrel section 20 from closing into the firing position, because the length of first diameter 23 is not long enough to accommodate such shells and will protrude from the barrel section 20. Consequently, the configuration of barrel sleeves 22 and 22' operatively prevents launcher from being used with standard lethal ammunition.

Figure 8:
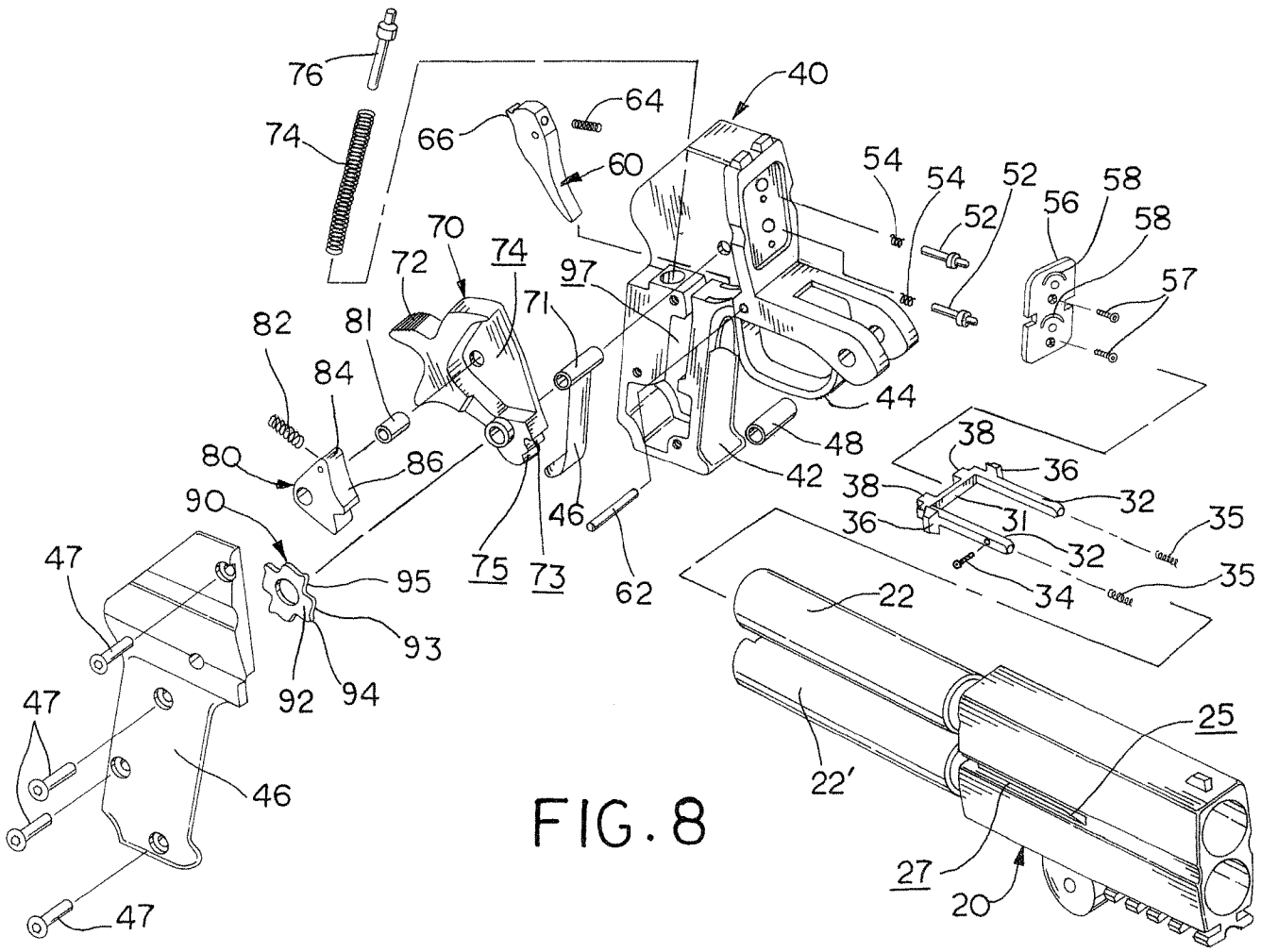
FIG. 8 is an exploded view of the launcher of FIG. 1.

As best shown in FIG. 8, receiver section 40 houses the launcher's fire control mechanism 50. Fire control mechanism 50 uses a traditional single action operation, where the user must manually "cock" the hammer before the trigger can be pressed to discharge the less-lethal round. Fire control mechanism 50 also ensures that rounds are alternatively discharged from each barrel and prevents rounds from both barrels from being discharged simultaneously.

Figure 10:
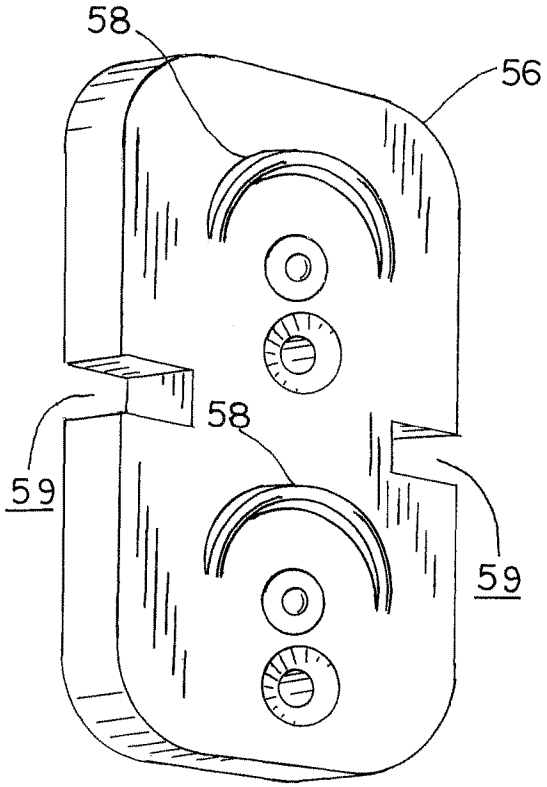
FIG. 10 is a perspective view of the back plate of the launcher of FIG. 1.
Figure 12:
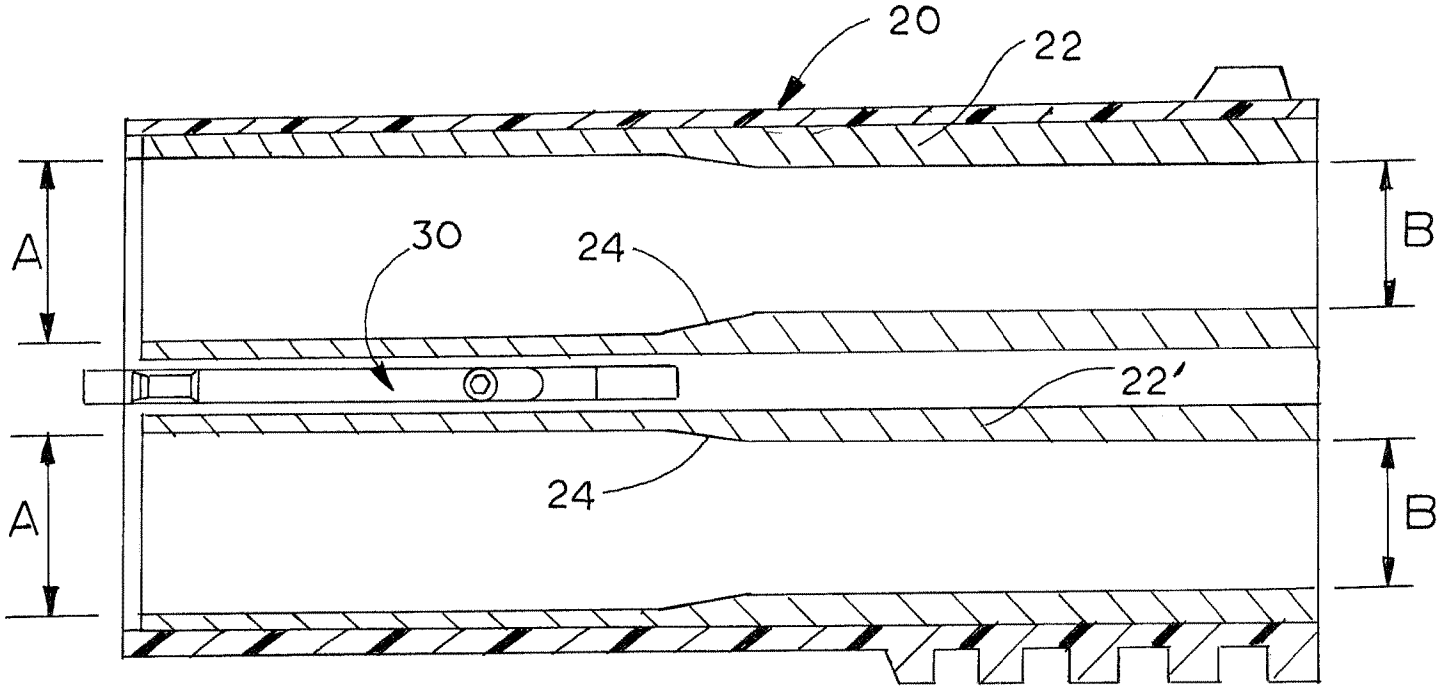
FIG. 12 is a partial side sectional view of the less-lethal ballistic projectile round of FIG. 11 taken along line 12-12.

The working parts of fire control mechanism 50 are disposed within the receiver section 40 and held in place by a side cover plate 46 attached to the section with screws 47. The main working parts of fire control mechanism 50 include: two firing pins 52, a trigger 60, a hammer 70, a rocker 80 and rocker spur 90. Each firing pin 52 is disposed in bores in receiver section 40 and biased by a spring 54. Both firing pins 52 are retained within receiver section 40 behind back plate 56, which is held to receiver section 40 by screws 57. As best shown in FIG. 10, back plate 56 has a curved rib 58 that protrudes from its face above each firing pin 52. Trigger 60 is pivotally connected to receiver section 40 by roll pin 62 and biased by trigger spring 64 seated in a bore within receiver section 40. Trigger 60 also includes a pawl 66. Hammer 70 is pivotally connected to receiver section 40 by roll pin 71. Hammer 70 has a hammer spur 72 and a pair of edges or sear notches 73 and 75, which provide the sear function of the fire control mechanism and operatively receive pawl 66 of trigger 60. Hammer spring 74 and strut pin 76 are seated within a bore descending into the grip area of receiver section 40. Hammer spring 74 urges hammer 70 forward toward barrel section 20. Rocker 80 is carried within a recessed pocket 79 in hammer 70 and is pivotally connected to hammer 70 by roll pin 81. Rocker 80 is also urged forward by spring 82 which is seated in a bore in the rear edge of rocker 80 and compressed against the inner edge 78 of hammer 70. Rocker 80 has an arc side that provides two spaced strike faces (an upper strike face 84 and a lowers strike face 86). Rocker spur 90 is carried by hammer 70 and rotatably connected to the hammer by roller pin 91, which pivotally connects the hammer to receiver section 40. As shown, rocker spur 90 has a cover leaf shape with four lobes 92. Each lobe 92 has a top contact edge 93 and a side contact edge 95, which converge to form a corner rocker stop 94. Rocker spur 90 is biased by a leaf spring 96 which is seated within an elongated pocket 97 formed in the handle area of receiver section 40.

Figure 9:
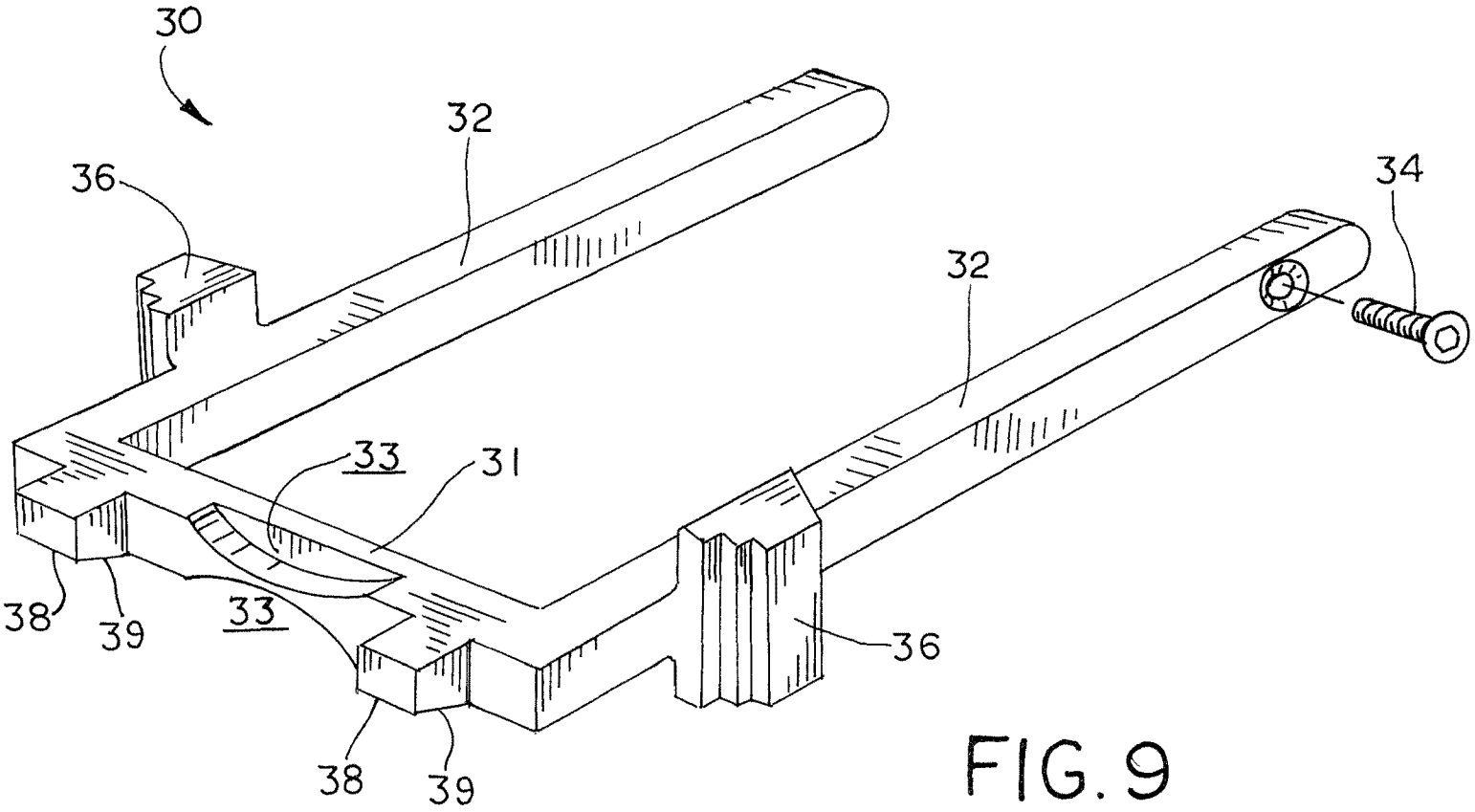
FIG. 9 is a perspective view of the ejector used in the launcher of FIG. 1.

Barrel section 20 also includes an ejector 30 that is slidably held within the barrel section. As best shown in FIG. 9, ejector 30 has a cross member 31 and two parallel legs 32 that slide within a longitudinal slot 21 formed in the sides of barrel section 20. One of the legs 32 has a threaded through bore 35 for receiving a retaining screw 34. On the side of barrel section 20 as the ejector leg 32 having retaining screw 34, a secondary slot 27 is formed so that the retaining screw extends through the leg into the secondary slot and limits the travel of ejector 30 to the length of that secondary slot. Ejector springs 35 inserted into bores 29 in barrel section 20 urge ejector 30 out of the rear end of the barrel section. Tabs 36 extend outwardly from the sides of each leg 32. Cross member 31 has rounded grooves 33 for receiving the shell casing flanges of the less-lethal rounds. Cross member 31 also has a pair of nubs 38 that protrude rearward opposite of legs 32. Each nub 38 has a chamfer 39 on its lower edge. In the firing position, nubs 38 fit into side notches 59 formed in back plate 56 locking barrel section 20 in the closed firing position. Springs 35 exert a constant force on ejector 30 to keep nubs 38 seated within notches 59, thus maintaining barrel section 20 in the closed firing position. When a user wishes to open the launcher moving the barrel section to the loading position, the user will push forward on tabs 36 of ejector 30. The forward movement of ejector 30 retracts nubs 38 from notches 59 allowing barrel section 20 to pivot forward to the loading position.

Figure 14:
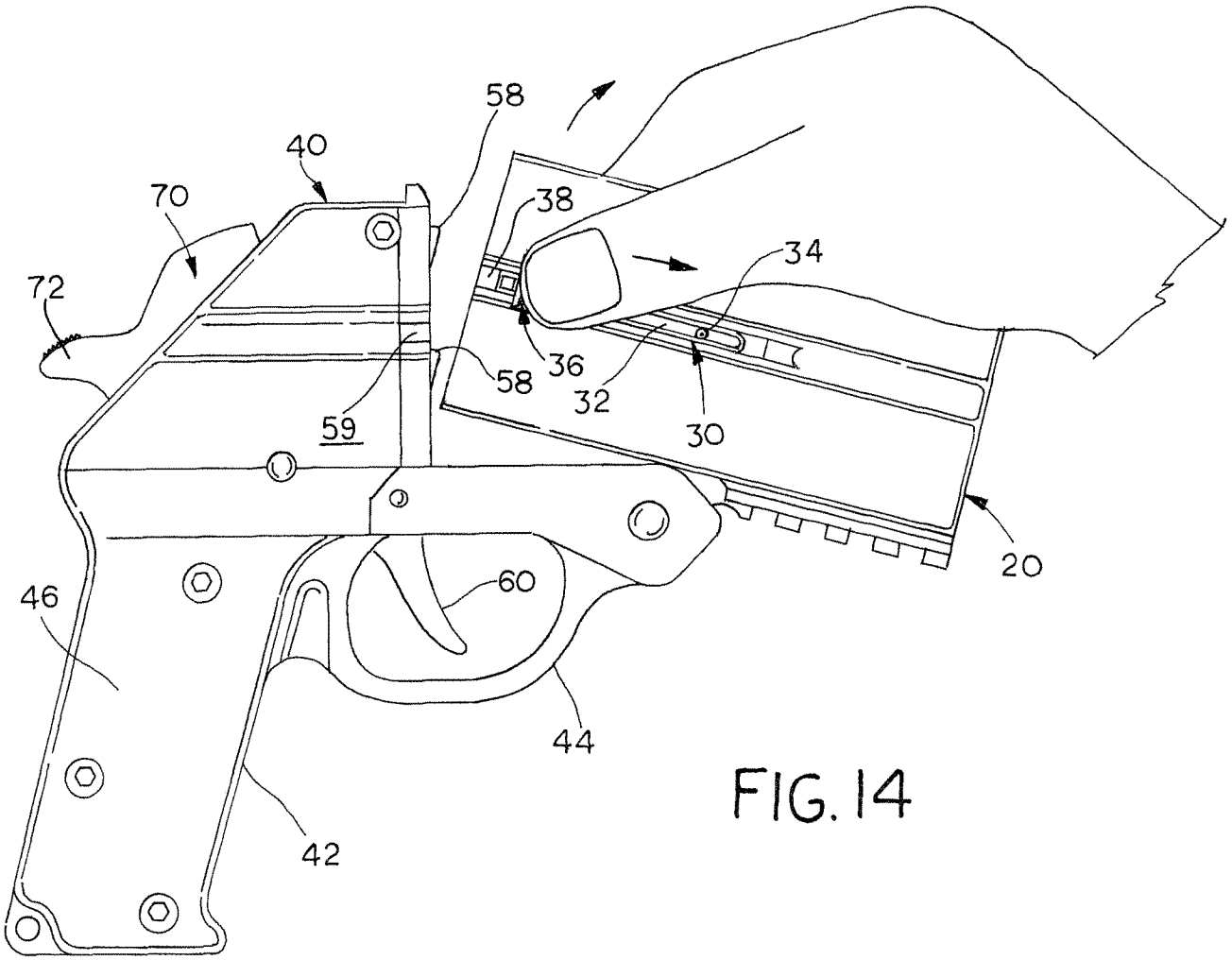
FIG. 14 is a side view of the launcher of FIG. 1 showing the barrel section moving to the open loading position.
Figure 15:
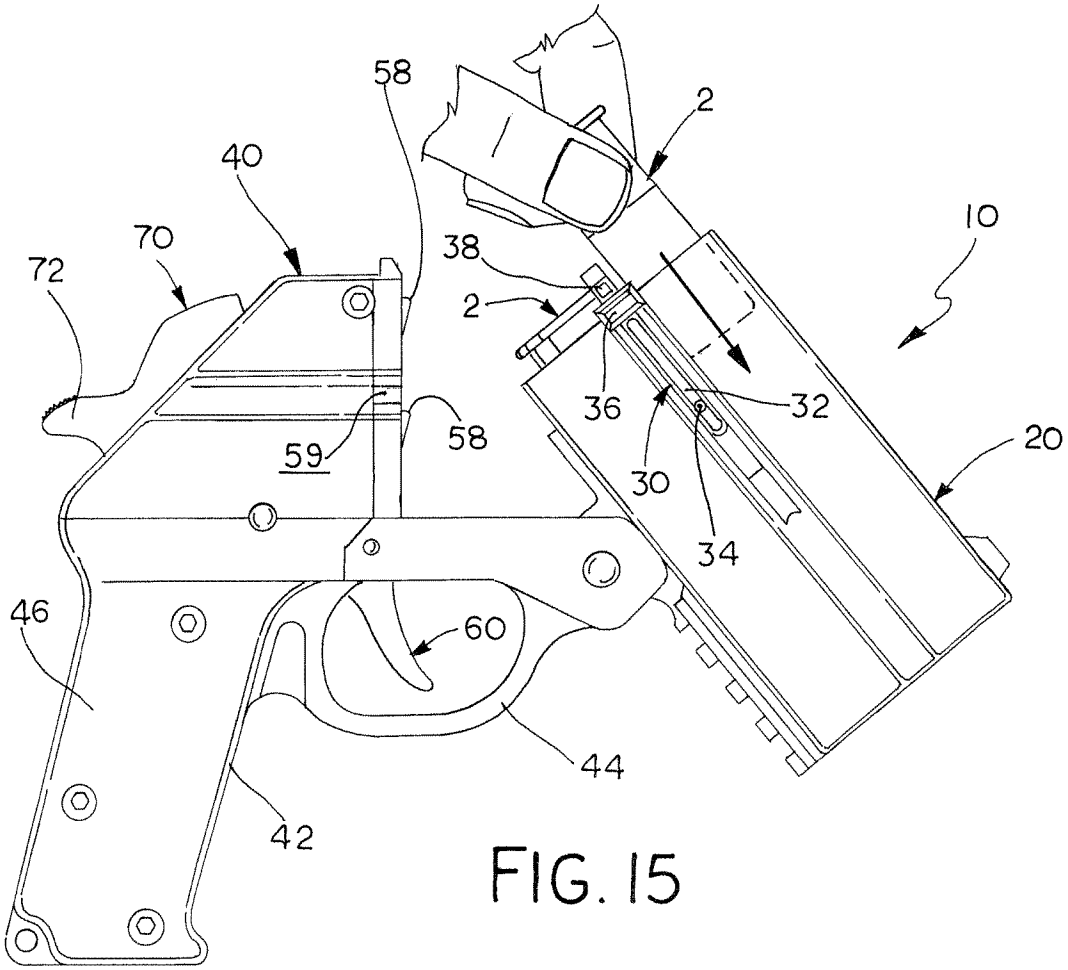
FIG. 15 is a side view of the launcher of FIG. 1 showing less-lethal rounds being loaded into the barrel sleeves.
Figure 16:
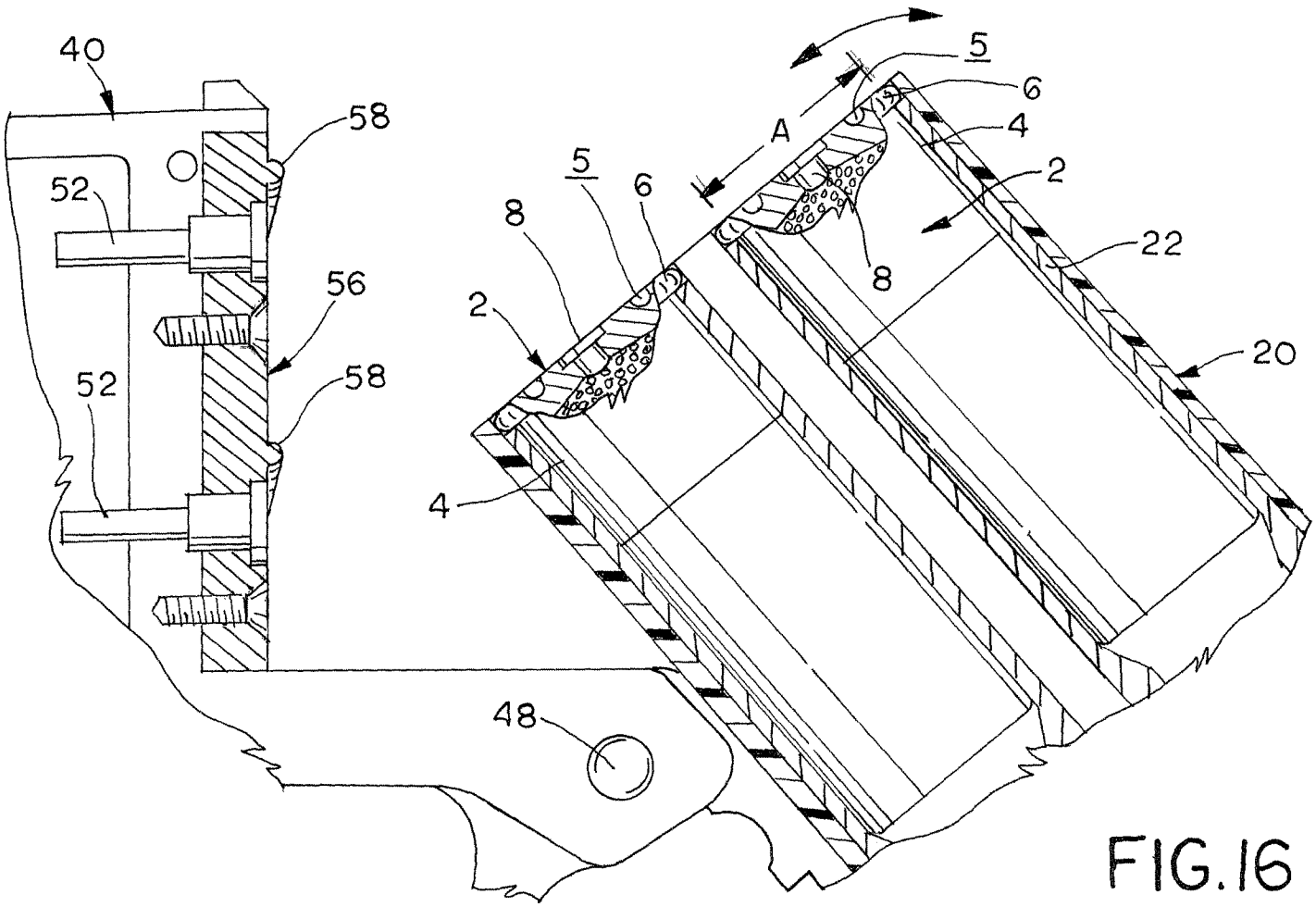
FIG. 16 is a partial side sectional view of the launcher of FIG. 1 with the barrel section in the open loading position showing the mating less-lethal projectile rounds loaded within the barrel sleeves.
Figure 17:
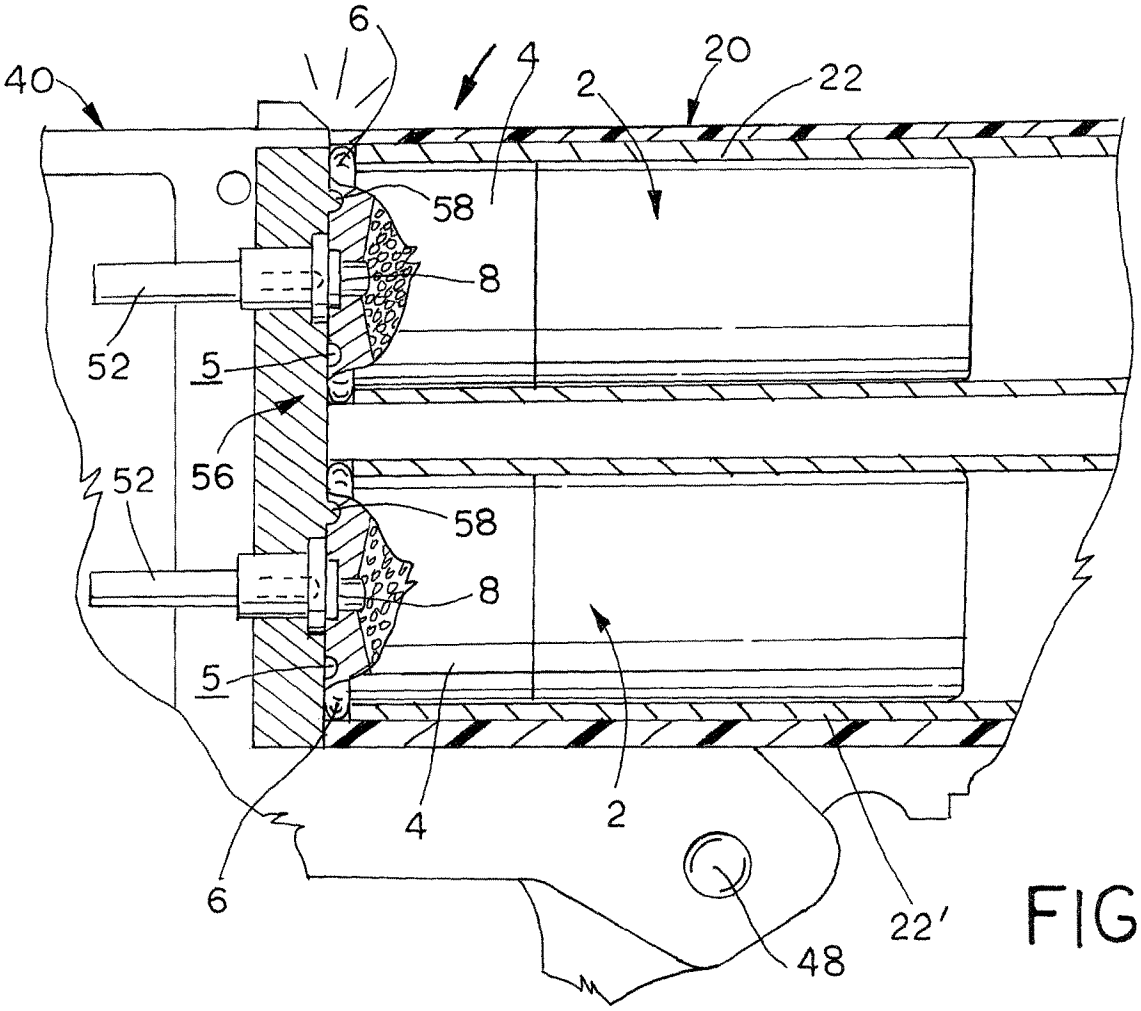
FIG. 17 is a partial side sectional view of the launcher of FIG. 1 with the barrel section in the closed firing position showing the mating less-lethal projectile rounds loaded within the barrel sleeves.

FIGS. 13-19 illustrate how launcher 10 is manually loaded and unloaded. It should be noted that launcher 10 cannot be loaded without hammer 70 being pulled into the "pre-cocked" position placing the launcher in the "safe/load" mode. Pulling hammer 70 to the pre-cocked positions pulls rocker 80 from contact with either of the firing pins 52, so that a round cannot be inadvertently discharged when barrel section 20 is swung back to the closed fire position. The user pulls ejector 30 forward (FIG. 13) and swings barrel section 20 to the open position (FIG. 14). Once barrel section 20 is in the open load/unload position, the user can manually insert the mating less-lethal projectile rounds 2 into each barrel sleeve 22 (FIG. 15).

Figure 18:
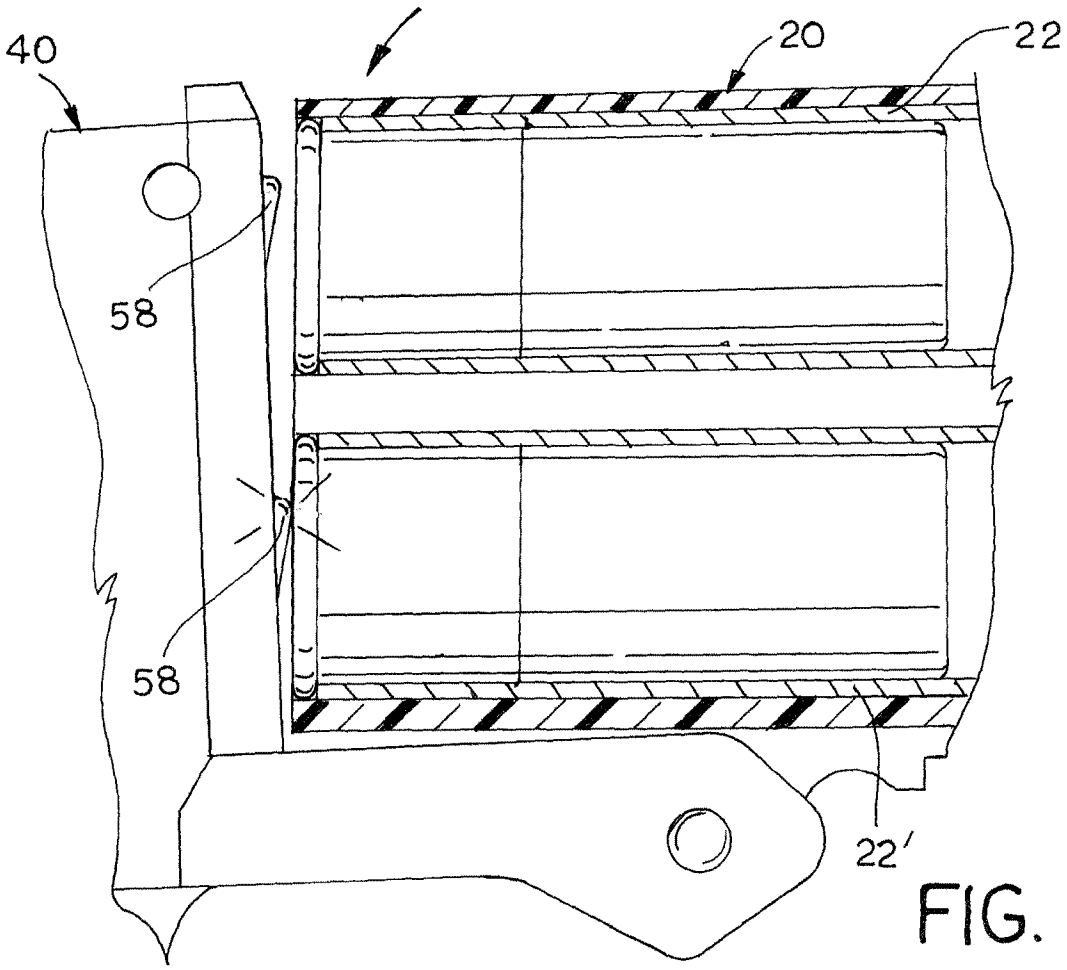
FIG. 18 is a partial side sectional view of the launcher of FIG. 1 with non-mating less-lethal projectile rounds loaded within the barrel sleeves, which prevent the barrel section from being closed.
Figure 19:
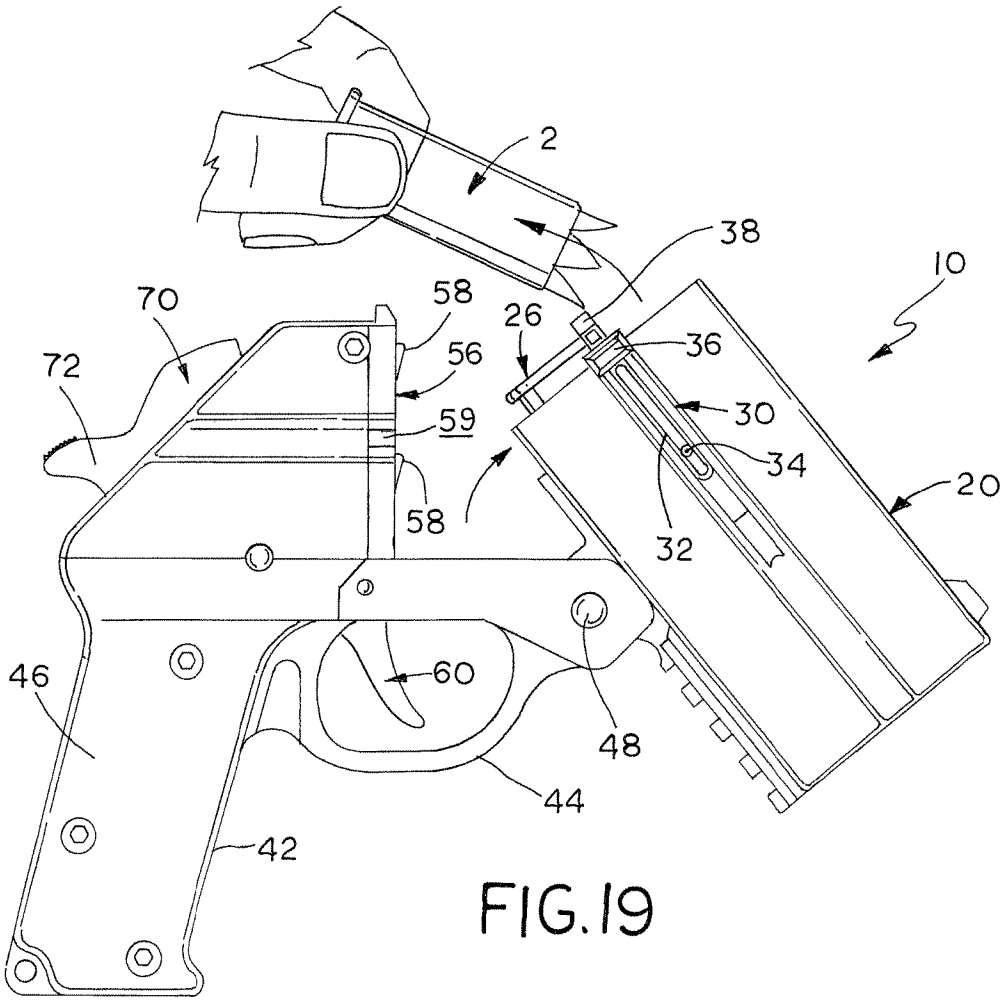
FIG. 19 is a side view of the launcher of FIG. 1 showing spent less-lethal rounds being pulled from the barrel sleeves.

When barrel section 20 is loaded with mating rounds 2 and closed in the firing position (FIG. 17), ribs 58 of back plate 56 seats within annular recess 5 of rounds 2. Ribs 58 are specifically positioned and configured on back plate 56 so that only the specially mating less-lethal projectile rounds can be used in launcher 10. As shown in FIG. 18, ribs 58 would prevent barrel section 20 from being closed when loaded with a non-mating less-lethal round or conventional ammunition. In other embodiments of this invention, the back plates and mating less-lethal projectile rounds may configured with other mating structures within the teachings of this invention. By way of example as shown in FIGS. 28-30, back plate 100 may includes a pair of pintle 102 which seat within the annular recess 5 of mating less-lethal projectile rounds 2.

It should be further noted that when rounds 2 are inserted into barrel sleeves 22, the flanges of shell casings 4 partially seat within the grooves 33 of ejector 30. Once rounds 2 have been spent, the user again pulls ejector 30 forward and swing barrel section 20 to the open load/unload position (FIG. 14). When barrel section 20 is opened, the spent rounds 2 are partially expelled from the barrel sleeves by ejector 30, which is urged rearward by springs 35. Round grooves 33 in cross member 31 catch flanges 6 of the shell casings 4 and partially expel the spent rounds from the rear end of barrel section 20.

Figure 20:
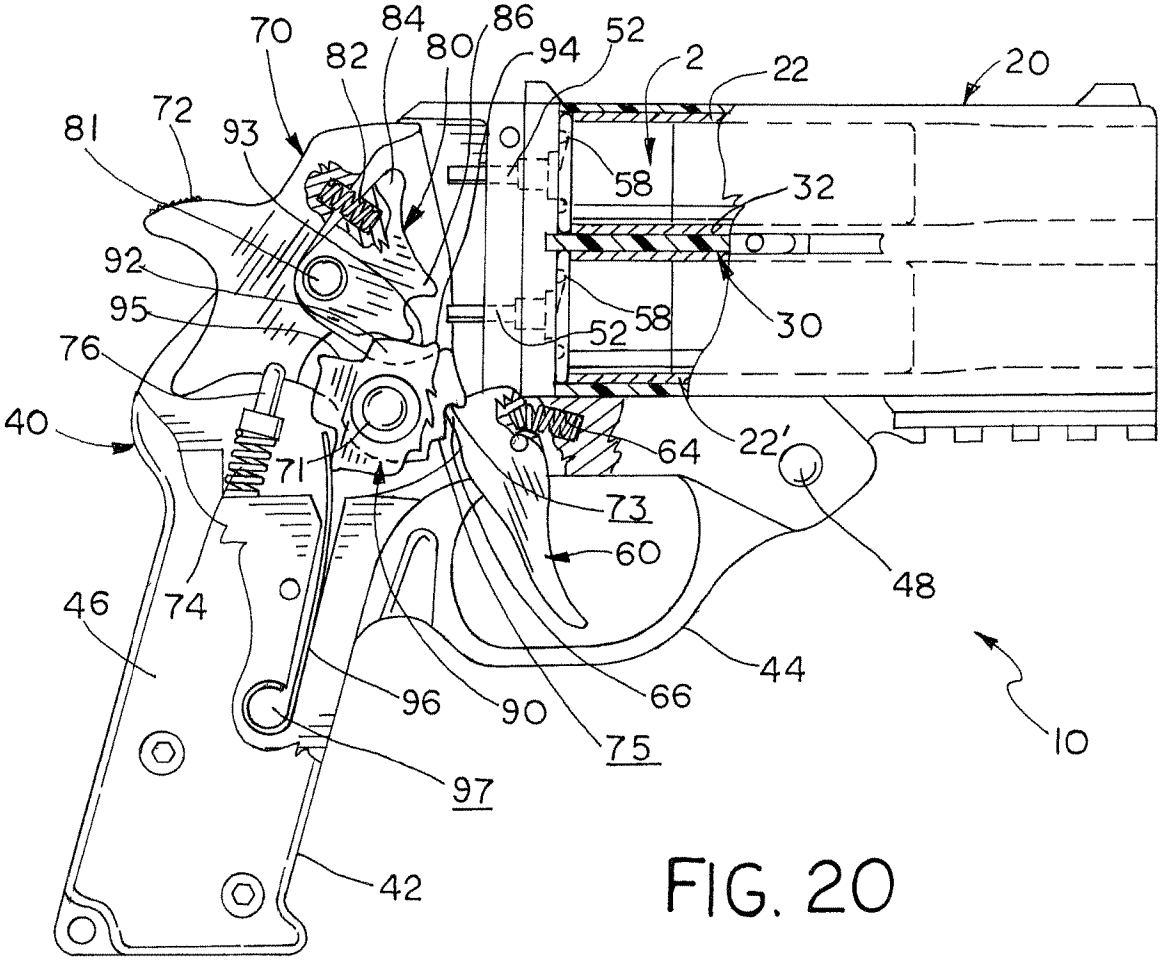
FIG. 20 is a side view of the launcher of FIG. 1 with a portion cut away to show the internal working parts of the launcher in a "safe/load" mode.

FIGS. 20-27 illustrate the operation of fire control mechanism 50 of launcher 10. FIG. 20 shows launcher 10 in an initial "safe/pre-cock" or "safe/load" mode with the mating less-lethal projectile rounds 2 inserted into barrel sleeves 22 and 22', and with barrel section 20 locked in the closed firing position. In the "safe" mode, trigger pawl 66 restrictively seats within sear notch 73, which prevents the user from pressing the trigger and discharging either of rounds 2. It should be noted that in the safe mode, both strike faces 84 and 86 of rocker 80 are physically spaced from firing pins 52. The bottom of rocker 80 rests on top contact edge 93 of one of four rocker lobes 92.

Figure 21:
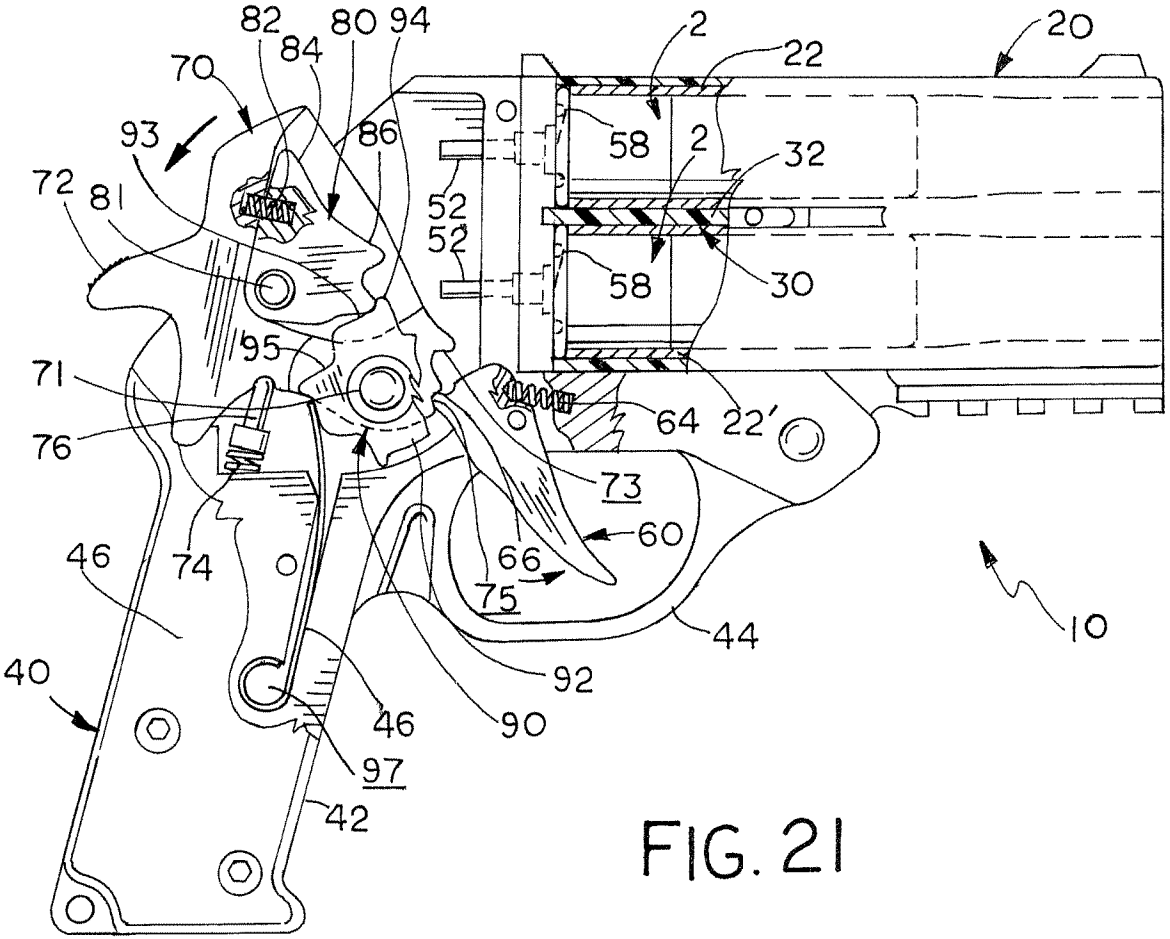
FIG. 21 is a side view of the launcher of FIG. 1 with a portion cut away to show the internal working parts of the launcher in a "cocked" mode with the rocker in a upper barrel firing position.

FIG. 21 shows the launcher 10 in a "cocked" mode with rocker 80 in an upper barrel firing position. When manually "cocked", that is pulled to the rear, hammer 70 rotates about roll pin 71 and trigger pawl 66 slides out of engagement with sear notch 73 and into engagement within sear notch 75. With trigger pawl 66 seated within sear notch 75, trigger 60 is moved forward slightly within the trigger well of trigger guard 44 under the force of trigger spring 64. Cocking hammer 70, also alternatively indexes the position of rocker 80 between firing the upper barrel sleeve 22 and the lower barrel sleeve 22'. As hammer 70 is cocked, the bottom of rocker 80 slides along top contact edge 93 into abutment with corner stop 94 of rocker lobe 92, which pivots rocker 80 upward within the recessed pocket 79 of hammer 70. Rocker spur spring 96 prevents rocker spur 90 from rotating with hammer 70 as it is cocked.

Figure 22:
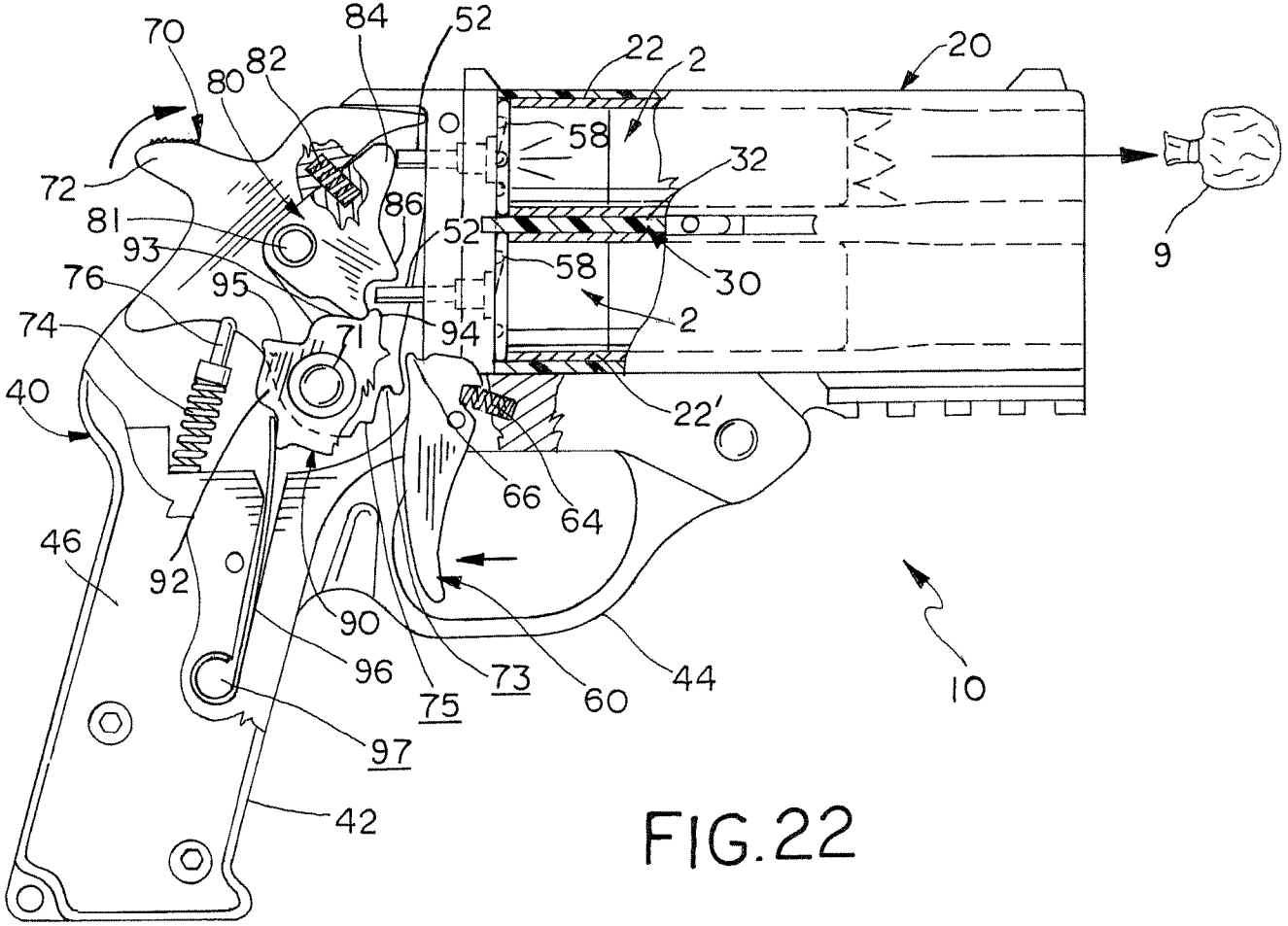
FIG. 22 is a side view of the launcher of FIG. 1 with a portion cut away to show the internal working parts of the launcher discharging the round from the upper barrel sleeve.
Figure 26:
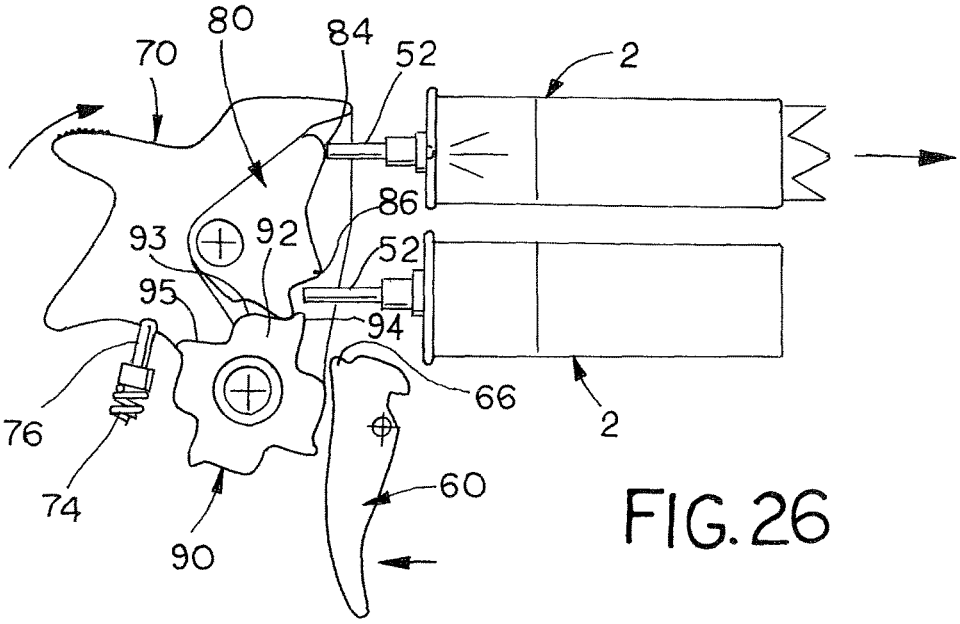
FIG. 26 is a simplified sectional view of the fire control mechanism used in the launcher of FIG. 1 showing the rocker striking the firing pin of the upper barrel sleeve.

FIGS. 22 and 26 show the launcher 10 discharging the round from the upper barrel sleeve 22. When trigger 60 is pressed rearward from the "cock" mode, trigger pawl 66 is pulled out of engagement within sear notch 75 and hammer 70 is slammed forward under the force of hammer spring 74. The forward movement of hammer 70 drives upper strike face 84 of rocker 80 into the firing pin 52 for the upper barrel sleeve 22, while lower strike face 86 is spaced from the firing pin 52 for the lower barrel sleeve 22'. Rocker 80 drives firing pin 52 forward, which impacts primer 8 discharging round 2. The position of rocker 80 pivoted upward within hammer pocket 79 caused by the abutment with rocker spur 90 ensures that rocker 80 only contacts the firing pin 52 for the upper barrel sleeve 22.

Figure 23:
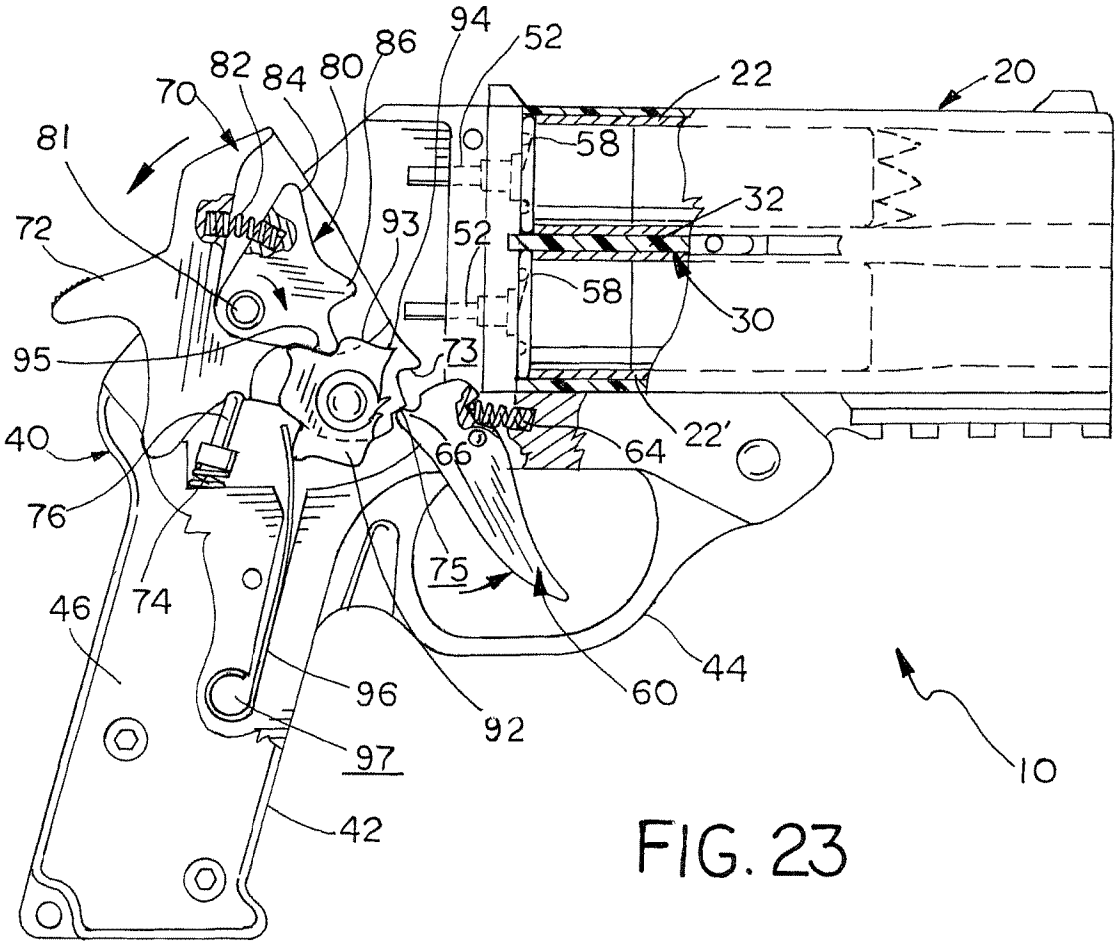
FIG. 23 is a side view of the launcher of FIG. 1 with a portion cut away to show the internal working parts of the launcher in "cocked" mode with the rocker in a lower barrel firing position.

FIG. 23 shows the launcher 10 in a subsequent "cocked" mode with rocker 80 in a lower barrel firing position. A subsequent, cocking of hammer 70 again moves trigger pawl 66 out of engagement with sear notch 73 and into engagement within sear notch 75; however, the bottom of rocker 70 now slides off of the top contact edge 93 of one lob 92 and rests against the end contact edge 95 of the adjacent lob 92', which pivots the rocker downward within the recessed pocket 79 of hammer 70. Rocker 80 is held down in this position by spring 82. Again, rocker spur spring 96 prevents rocker spur 90 from rotating with hammer 70 as it is cocked.

Figure 24:
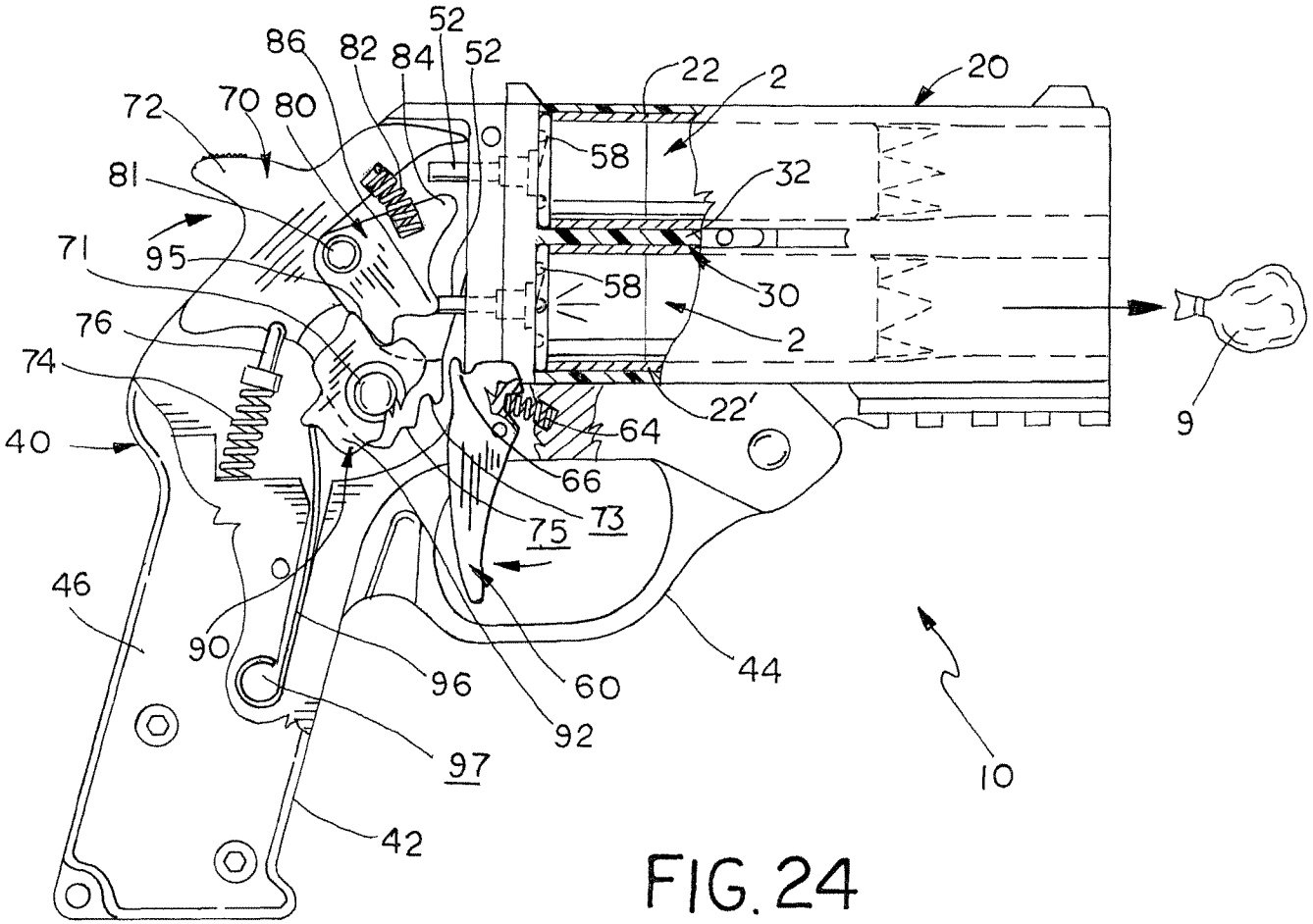
FIG. 24 is a side view of the launcher of FIG. 1 with a portion cut away to show the internal working parts of the launcher discharging the round from the lower barrel sleeve.
Figure 27:
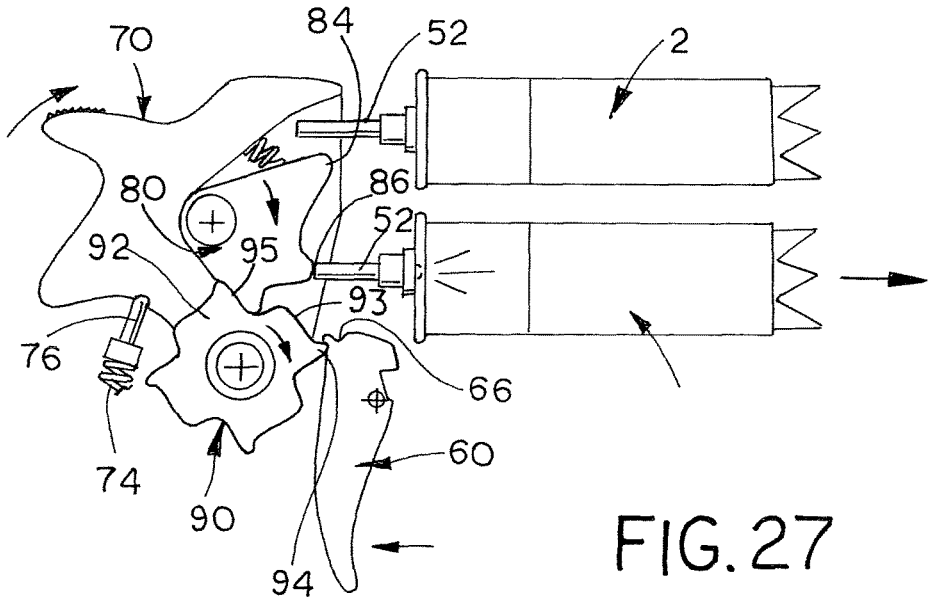
FIG. 27 is a simplified sectional view of the fire control mechanism used in the launcher of FIG. 1 showing the rocker striking the firing pin of the lower barrel sleeve.

FIGS. 24 and 27 show the launcher 10 discharging the round from the lower barrel sleeve 22'. Now when trigger 60 is pressed rearward and hammer 70 slams forward, lower strike face 86 of rocker 80 impacts the firing pin 52 for the lower barrel sleeve 22' and upper strike face 84 is spaced away and under the firing pin 52 for upper barrel sleeve 22. Again, the position of rocker 80 pivoted downward within hammer pocket 79 caused by the abutment with rocker spur 90 ensures that rocker 80 only contacts the firing pin 52 for the lower barrel sleeve 22'.

Figure 25:
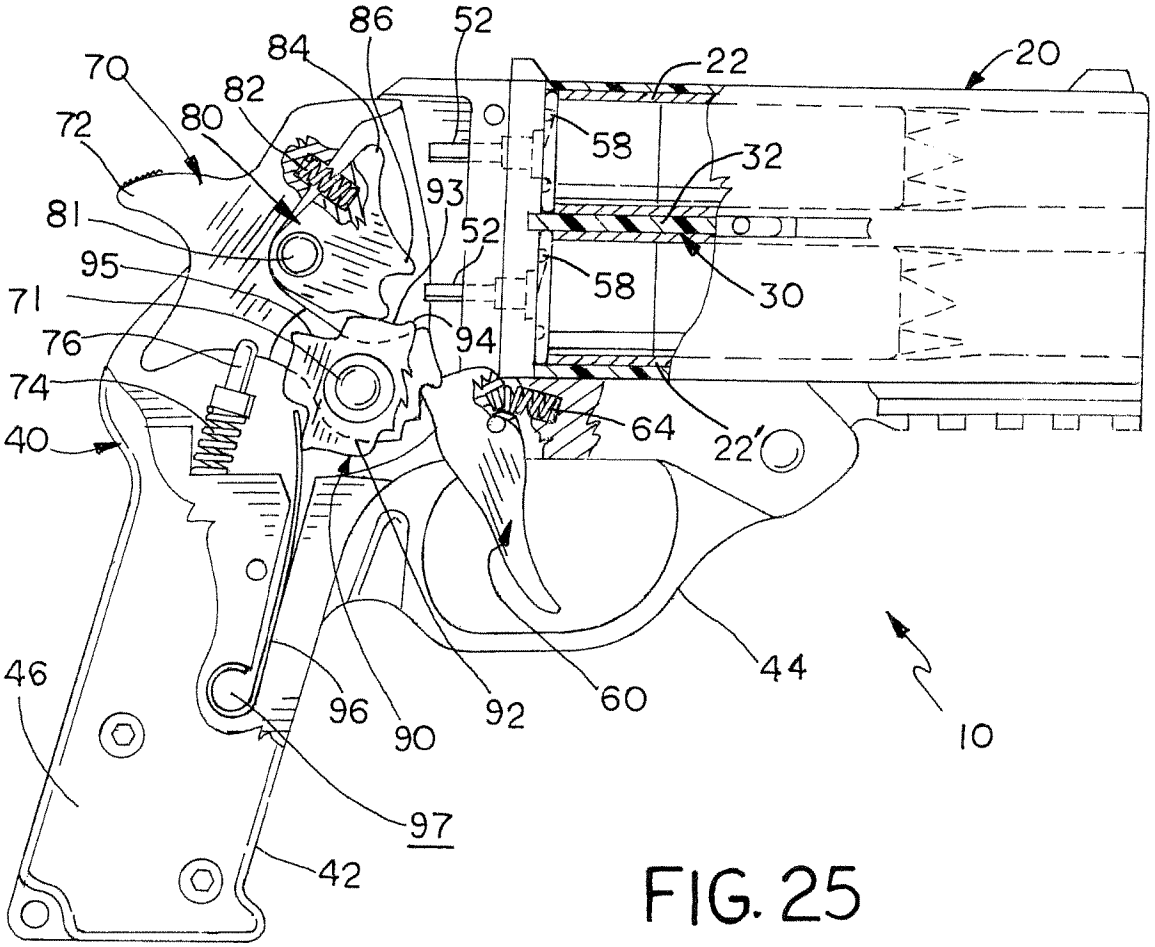
FIG. 25 is a side view of the launcher of FIG. 1 with portion cut away to show the internal working parts of the launcher in "safe/load" mode with expended rounds ready to be ejected.

FIG. 25 shows launcher 10 back in an initial "safe/pre-cocked" or "load/unload" mode with the spent rounds 2 ready to be unloaded. After, one or in this case as illustrated, both rounds 2 have been spent, hammer 70 can be partially cocked to the "pre-cocked" or "load/unload" mode so that barrel section 20 can be opened and the spent rounds 2 unloaded. Again, in this mode, trigger pawl 66 restrictively seats within sear notch 73, which prevents the user from accidently pressing trigger 60 and discharging an unspent round.

One skilled in the art will note that the present invention provides several advantages over conventional firearms that are converted for less-lethal ballistic projectile rounds. The handgun configuration allows the launcher to be manipulated, held and fired with one hand, as well as being conveniently carried and holstered. The over/under double barrel configuration provides a two shot capacity. The bodies of the receiver and barrel sections are constructed of reinforced polymer materials for durability and light-weight. The break-open load action and ejector allows the launcher to be easily loaded and unloaded. The ejector provides a dual function in that it locks the barrel section in the firing position and pulls the spent rounds from the barrel section to ease reloading. The fire control mechanism uses a traditional single action operation for simplicity of use and reliability. In addition, the fire control mechanism ensures that rounds are alternatively discharged from each barrel and prevents rounds from both barrels from being discharged simultaneously. The design and configuration of the barrel section and back plate ensures that the launcher only operates using less-lethal ballistic projectile rounds and cannot be loaded or used with deadly firearm ammunition. In other embodiment of the launcher, the back plate can modified to accommodate standard less-lethal projectile rounds as desired.

The embodiments of the present invention herein described and illustrated are not intended to be exhaustive or to limit the invention to the precise form disclosed. They are presented to explain the invention so that others skilled in the art might utilize its teachings. The embodiment of the present invention may be modified within the scope of the following claims.

We claim:

1. The combination of a less-lethal ballistic projectile round and a handheld launcher, the round comprising: a shell casing having an annular recess formed in a flat end around a primer and a projectile, and the launcher comprising:

a receiver section constructed of a polymer material, the receiver section includes a handle grip and a back plate;

a barrel section constructed of a polymer material and pivotally connected to the receiver section for movement between an open position spaced from the back plate and a closed position abutting the back plate, the barrel section includes a first and second tubular barrel sleeve, each of the first and second barrel sleeve having an axial bore with a rear end for receiving one of the rounds therein, and a forward end from which the projectile is propelled from the barrel section, the first and second barrel sleeves constructed of a metal and fitted into the barrel section with the first barrel sleeve over lying axially parallel the second barrel sleeve; and a fire control mechanism housed within the receiver for discharging the rounds loaded into the barrel sleeve, the fire control mechanism includes a first and second firing pin, a hammer pivotally connected to the receiver part for movement between a cocked position and an un-cocked position, a rocker part pivotally carried by the hammer for alternatively engaging the first and second firing pins when the hammer is in the un-cocked position, and a spur part rotatably carried by the hammer operatively engaged with the rocker part to selectively position the rocker part relative to the hammer to alternatively discharge the round loaded from one of the first and second barrel sleeves while preventing the round loaded in either each of the first and second barrel sleeve from being discharged simultaneously;

a first and second curved ribs extending from the back plate toward the barrel section for preventing the barrel section from pivoting into the closed position when the barrel sleeve rear end is loaded with other than the round, whereby one or more of the first and second ribs restrictively seat within the annular recess of one or more of the rounds loaded into the first and second barrel sleeves and the barrel section is in the closed position; and an ejector slidably retained within the barrel section for partially ejecting the round from the barrel sleeve rear end and for engaging the back plate to lock the barrel section in the closed position, the ejector includes a nub, the nub being received within a notch within the receiver section when the barrel section is in the closed position, thereby locking the barrel section relative to the receiver section, the ejector also has a rounded groove therein for receiving the shell casing of the round, the ejector contacted by a spring disposed within the barrel section urging the ejector toward the receiver section so that the ejector catches the flange of the shell and partially ejects the round from the barrel sleeve.

* * * * *